US007473834B2

(12) United States Patent
Yoshino

(10) Patent No.: US 7,473,834 B2
(45) Date of Patent: Jan. 6, 2009

(54) ELECTRONIC PERCUSSION INSTRUMENT

(75) Inventor: Kiyoshi Yoshino, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 653 days.

(21) Appl. No.: 11/007,743

(22) Filed: Dec. 8, 2004

(65) Prior Publication Data

US 2005/0145101 A1 Jul. 7, 2005

(30) Foreign Application Priority Data

Dec. 26, 2003 (JP) ..... 2003-434758
May 14, 2004 (JP) ..... 2004-145597

(51) Int. Cl.
*G10H 1/18* (2006.01)

(52) U.S. Cl. ..... 84/402; 84/742; 84/743; 84/615; 84/422.3

(58) Field of Classification Search ..... 84/422.3, 84/723–746, 402–409, 615
See application file for complete search history.

(56) References Cited

U.S. PATENT DOCUMENTS 4,517,876 A * 5/1985 Duhon ..... 84/422.3
5,262,585 A * 11/1993 Greene et al. ..... 84/645
5,915,289 A * 6/1999 Hart ..... 84/738
5,965,834 A * 10/1999 Suenaga et al. ..... 84/422.3
6,072,112 A * 6/2000 Suenaga et al. ..... 84/422.3
6,307,137 B1 * 10/2001 Liao ..... 84/422.3
6,316,708 B1 * 11/2001 Kuppers ..... 84/422.3
6,320,109 B1 * 11/2001 Kuppers ..... 84/422.3
6,331,667 B1 * 12/2001 Kuppers ..... 84/422.3
6,417,434 B1 * 7/2002 Lao ..... 84/422.3
6,815,604 B2 * 11/2004 Toda ..... 84/746
6,822,148 B2 * 11/2004 Yanase ..... 84/422.1
2002/0059861 A1 * 5/2002 Yoshino et al. ..... 84/402
2003/0200860 A1 * 10/2003 Toda ..... 84/746
2003/0221545 A1 * 12/2003 Tomoda ..... 84/723
2004/0255765 A1 * 12/2004 Mori et al. ..... 84/742

FOREIGN PATENT DOCUMENTS

JP 2003-167574 6/2003
JP 2003/195857 7/2003

* cited by examiner

*Primary Examiner*—David S. Warren
(74) *Attorney, Agent, or Firm*—Foley & Lardner LLP

(57) ABSTRACT

An electronic percussion instrument that allows for a performance sensation that is similar to that of an acoustic HiHat cymbal. A sliding mechanism of a top cymbal pad section and a bottom cymbal pad section of an electronic HiHat cymbal where the top cymbal pad section and the bottom cymbal pad section are both fixed so that they can swing together when the top cymbal pad section is struck. Even when the first cymbal pad is struck and swings coming into contact with the second cymbal pad, the gliding contact between the first pad and the second pad is carried out smoothly and allows for a natural striking sensation comparable to that of an acoustic HiHat cymbal.

68 Claims, 14 Drawing Sheets

( a )

( b )

ELECTRONIC PERCUSSION INSTRUMENT

CROSS-REFERENCE TO RELATED PATENT APPLICATIONS

Japan Priority Application 2003-434758, filed Dec. 26, 2003 including the specification, drawings, claims, and abstract, is incorporated herein by reference in its entirety. Japan Priority Application 2004-145597, filed May 5, 2004 including the specification, drawings, claims, and abstract, is incorporated herein by reference in its entirety.

BACKGROUND OF THE INVENTION

1. Field of the Invention

Embodiments of the present invention relate to an electronic percussion instrument having a smooth, sliding contact between a first cymbal pad and a second cymbal pad, the contact between the first and second cymbal pads resulting from a striking of the first cymbal pad.

2. Description of the Related Art

An electronic HiHat cymbal wherein a top cymbal pad moves up and down in response to the amount of pressure applied to a foot pedal and wherein the resulting performance sensation is the same as that of an acoustic HiHat is described in Japanese Laid-Open Patent Application Publication (Kokai) Number 2003-167574 (Patent Reference 1) and Japanese Laid-Open Patent Application Publication (Kokai) Number 2003-195857 (Patent Reference 2). The configuration of the electronic HiHat cymbals described in Patent Reference 1 and Patent Reference 2 is such that the top cymbal pad pivots when it is struck.

The bottom cymbal pad in electronic HiHat cymbals cited in prior art is fixed to a stand and cannot swing. Thus, even though the top cymbal pad pivots when struck, the bottom cymbal pad cannot pivot. The result is unsatisfactory from the standpoint of mimicking an acoustic HiHat cymbal pad.

In addition, the striking surface area of the electronic cymbal, which is part of the electronic HiHat cymbal, may be formed from an elastic material such as rubber or elastomer that is used for the purpose of damping. Moreover, in Patent Reference 1 and Patent Reference 2, the striking surface area of the top cymbal pad and the edge area that faces the bottom cymbal pad are both formed from an elastic material. The bottom cymbal pad also has an edge area that faces the top cymbal pad formed from an elastic material.

Therefore, the configuration of the electronic HiHat cymbal in Patent Reference 1 and Patent Reference 2 is such that the bottom cymbal pad is fixed so that it is not possible for it to swing and the friction between the elastic bodies in the electronic HiHat cymbal makes a striking sensation unnatural. When the bottom cymbal pad comes into contact with the vibrating top cymbal pad, the gliding contact between the top cymbal pad and the bottom cymbal pad is not carried out as smoothly as it is in an acoustic HiHat cymbal, in which both of the pads are made of metal.

SUMMARY OF THE INVENTION

Embodiments of the present invention provide an electronic percussion instrument in which when a gliding contact due to the striking of the top cymbal pad is produced, the top cymbal pad can slide smoothly on the bottom cymbal pad. Thus, a natural striking sensation similar to that of an acoustic cymbal can be obtained.

An electronic percussion instrument according to an embodiment of the invention comprises a first pad that has a striking surface comprising an elastic body, a first fixing element with which the first pad is fixed so that the pad is free to swing on a shaft that moves up and down in accordance with a specified operation, and a second pad that faces said first pad, and a second fixing element with which the second pad is fixed such that the pad is free to swing on the same shaft as the shaft of said up and down movement and in a position in which it is possible to transfer the swinging motion of said first pad, and a first sensor with which the striking of said first pad is detected.

The first pad is attached to a shaft that moves up and down in accordance with a specified operation. The first pad is attached to a first fixing element which allows it to freely pivot. A second pad is attached to a shaft that is placed on the same axis as said shaft that moves up and down. The first pad has a striking surface that is formed of an elastic body. When the first pad is struck, the striking is detected by a first sensor and the pad swings. In addition, when the first pad swings, the swinging motion of the first pad is transmitted to the second pad and the second pad also swings. Since the second pad swings together with the swing of the first pad, there is the advantageous result that it is possible to obtain a performance sensation that is the same as that of an acoustic HiHat cymbal.

In a further embodiment, a sliding member that promotes sliding of said first and second pad is placed in the area in which said first and second pad are in contact. Since a sliding member is furnished in the area in which the first pad and the second pad come into contact that promotes the mutual sliding of the pads, there is the advantageous result that even in those cases where the first pad is struck and swings coming into contact with the second pad, the gliding contact between the first pad and the second pad is carried out smoothly and it is possible to provide a natural striking sensation as if an acoustic HiHat cymbal is being struck.

In a further embodiment, said first and said second pad have a roughly circular shape, and said sliding member is placed on either said first or said second pad. The electronic percussion instrument has a first sliding member that protrudes from the surface on which it is attached in the direction of the diameter of said pad, and a flat shaped second sliding member that is placed on the outer periphery of said other pad in a position that faces the first sliding member.

Since the sliding member has a first sliding member (that has a roughly arc shaped portion that has been disposed on the outer periphery of either of said first pad or said second pad, and that protrudes from the attachment surface in the cross-section of the direction of the diameter) and the second flat sliding member (that has been disposed in a location that is opposite the first sliding member on the outer periphery of the other pad), the point of contact between the first sliding member and the second sliding member is a point on the diameter on one of either the first pad or the second pad, which can be made with as small a contact area as possible. Because of this, there is the advantageous result that the gliding contact between the first sliding member and the second sliding member can be carried out smoothly.

In a further embodiment, said sliding member is a tube shaped member that has a roughly toroidal shape. Since the first sliding member is a tube shaped member that is arranged roughly in a toroidal shape with the center of one of the pads made the center, there is the advantageous result that even in those cases where there has been a swinging movement with the first pad and the second pad coming into contact, no matter whether back and forth or left and right, the gliding contact between the first pad and the second pad can be carried out smoothly.

In a further embodiment, wherein said second sliding member is such that the length in the direction in which said first sliding member is in contact and slides is at least the distance that said first sliding member slides based on the striking of said first pad or greater. Therefore, there is the advantageous result that the contact between the first sliding member and the second sliding member is maintained satisfactorily even when due to the striking of the first pad and the gliding contact between the first pad and the second pad can be carried out smoothly.

In addition, since the first sliding member comprises a tube shaped member, the area of contact with the second sliding member becomes linear. Therefore, the contact area is increased to a proper degree and, as a result, it is possible to lower the pressure moderately. Accordingly, with a first sliding member having this kind of configuration, it is possible in the case where, for example, a pressure sensitive sensor is disposed on the second sliding member, to apply a proper degree of pressure on the pressure sensitive sensor.

In a further embodiment, wherein the instrument has a sensor that detects if said first sliding member that protrudes from the surface in said first or second pad to which it is attached has made contact with said second sliding member or if said second sliding member has been pressed. The second sensor with which the pressing is detected may be disposed on the second sliding member in a location that is opposite the roughly arc shaped portion that protrudes from the attachment surface of said first sliding member. Therefore, since the second sensor that is disposed on the second sliding member comes into contact with or is pressed by the arc of the first sliding member on the cross-section in the direction of the diameter of either one of the pads, the first pad or the second pad, the contact or the pressing is in a condition in which the pressure is focused as much as possible. Accordingly, there is the advantageous result that the second sensor can be operated more reliably.

In a further embodiment, said second sensor comprises a first film member with a first conductive pattern and a second film member with a second conductive pattern on the surface that is opposite to the surface with the first conductive pattern on the first film member. The second sensor is placed between the first and second film members. It consists of an insulating member that comprises an insulating body with a plurality of pass-through areas. The insulating body allows for said first conductive pattern and said second conductive pattern to come into contact when either said first or said second film member has been pressed by said first sliding member that protrudes from the surface to which it is attached.

In a further embodiment, the second sensor is a layered body comprising a first film member and an insulating film member. When in a static state, the first conductive pattern formed on said first film member, and the second conductive pattern formed on said second film member are not in contact because of said insulating film member. Furthermore, the insulating film member comprises a plurality of pass-through areas. When either said first or said second film member is pressed by said first sliding member that protrudes from the surface to which it is attached, said first conductive pattern and said second conductive pattern that are respectively exposed through said pass-through areas can come into contact. Thus, a conduction of an electric current becomes possible. When this kind of pass-through area is formed in a plurality, there is support in a plurality of locations by the insulation film member that remains between pass-through area and pass-through area. Consequently, there is the advantageous result that it is possible to prevent the erroneous contact between the first conductive pattern and the second conductive pattern that can be produced due to the bending of the first film member or the second film member.

In a further embodiment, said first or said second pad that is furnished with said second sliding member further comprises a pair of said second sensors on the surface side that is opposite said first pad in positions on a line segment in the direction of the diameter roughly symmetrical with respect to the center. Since a pair of second sensors are disposed on the rear surface side of the pad that is furnished with the second sliding member, in a location that is roughly symmetrical with respect to the center on a line segment in the direction of the diameter, it is possible to effectively detect the state in which, for example, the first pad and the second pad have been closed.

In a further embodiment, said first pad comprises a first insert-through-hole placed roughly in the center of the electronic percussion instrument. The first insert-through-hole enables the first pad to be inserted through said shaft that moves up and down. Said first pad further comprises a concave section that has a groove-shaped bottom portion that passes through and transects roughly the center portion of said first insert-through-hole. Said first fixing element further comprises a rotation stopping member that can be fit so that there is play with respect to said concave section, a first checking member that checks and stops said first pad with respect to said rotation stopping member when the rotation stopping member has been fit to said concave section so that there is play, and a pad fixing member that fixes said first pad to said shaft that moves up and down that has been inserted through said first insert-through-hole. Said rotation stopping member comprises a section that fits into the groove shape of said concave section, and a second insert-through-hole placed in a position that corresponds to said first insert-through-hole with which it is possible to insert through said shaft that moves up and down when the rotation stopping member has been fit to said concave section so that there is play, and together with this, has an outer periphery that cannot pass through said first insert-through-hole.

When the rotation stopping member is fit to the concave section placed in the rear surface of the first pad so that there is play, the peaked portion of said rotation stopping member is in the groove in the bottom section of said concave section and has a shape that conforms to said groove. In addition, said first pad is pressed and stopped with respect to said rotation stopping member by the first checking member. Therefore, with said rotation stopping member, which has been fit to the concave section of said first pad, the apex on the peaked section of said rotation stopping member becomes a pivot, said first pad is made to swing in one direction like a balance scale and prevents rotation about said apex.

Here, said groove crosses through roughly the center portion of the first insert-through-hole that has been placed in roughly the center portion of said first pad. Moreover, said first and second insert-through-holes that are part of said rotation stopping member are placed in mutually corresponding locations when said rotation stopping member is fit to said concave section so that there is play. Therefore, when said rotation stopping member is fit to said concave section so that there is play, the shaft that moves up and down is inserted through roughly the center portion of said first pad. Said first pad is fixed to said shaft that moves up and down utilizing the pad fixing member. Said first pad is prevented from rotating with said shaft that moves up and down. More specifically, when the rotation stopping member is fit to the convex section that has been disposed on the rear surface of the first pad so that there is play, due to the shape of the groove on the bottom section of the convex section on the first pad and of the apices of the peaked sections of the rotation stopping member, there is the advantageous result that the first pad can be restricted to rotating around the periphery of the rotation preventing member on the semicircle side that is opposite the performer.

In a further embodiment, the instrument is furnished with a cylindrical member that is fixed as a single unit with said rotation stopping member. The cylindrical member protrudes from said peaked section side of said second insert-through-hole. A portion of its outer periphery has a male threaded portion with which it is possible for said shaft that moves up and down to be inserted through. It is also possible to insert through said first insert-through-section, and has a length that protrudes from previously mentioned first insert-through-section in those cases where said rotation stopping member has been fit to said concave section so that there is play. Said first checking member comprises a female threaded section that can be screwed onto said male threaded section. Said female threaded section is screwed onto said male threaded section and presses on said first pad. Thus, when the rotation stopping member has been fit to the concave section that has been disposed on the rear surface of the first pad so that there is play, the first pad is pressed and stopped against the rotation stopping member by the screwing of the female threaded section onto the male threaded section of the cylindrical member that protrudes from the first pad. Since in addition to the fact that the cylindrical member is fixed to the rotation stopping member to form a single unit, the first pad is pressed and stopped by means of a screw fastening format, there is the advantageous result that it is possible to press and stop the first pad against the rotation stopping member with an appropriate pressing and stopping force.

In a further embodiment, the instrument comprises a plate shaped sensor attachment member with which said first sensor is mounted and attached to said first pad. The sensor attachment member is attached by leaving a space between the portion with which said first sensor is mounted and the rear surface of said first pad. The first sensor may be attached to the rear surface side of the first pad, producing a space between the sensor and the pad by means of the plate shaped sensor attachment member on which the first sensor has been mounted. Therefore, since the structure is one in which the first sensor is not struck directly, there is the advantageous result that it is possible to make the detection sensitivity for the vibrations due to the striking of the first pad uniform.

In a further embodiment, the instrument is furnished with a plate shaped sensor attachment member with which said first sensor is mounted and attached to said first pad. The sensor attachment member is attached in one of the regions that are delimited by the extension of the line of the groove on the bottom section of said concave section on said first pad leaving a space between the portion with which said first sensor has been attached and said first pad. The first sensor may be attached to the first pad producing a space between the sensor and the pad by the plate shaped sensor attachment member on which the first sensor has been mounted in one of the regions that is delimited by a line extended from the groove on the bottom section of the concave section, which is the rear surface side of the first pad. Due to the fact that the groove on the bottom section of the concave section exists on the first pad, the striking portion on the first pad can be restricted to one of the regions that is delimited by a line extended from the groove on the bottom section of the concave section. Therefore, there is the advantageous result that the sensor attachment member may be attached only in the region that corresponds to the striking section and it is possible to design for a reduction in the manufacturing costs.

In a further embodiment, in the attachment of said sensor attachment member to said first pad, a latching hole in the outer edge section of one of either said sensor attachment member or said first pad lined up with said outer edge section, and a protuberant section that is disposed in a portion of a segment in the vicinity of the outer edge section of the other one lined up with said outer edge are mated. The sensor attachment member may be attached to the first pad by means of the mating together of a latching hole that has been disposed in a portion of a segment in the vicinity of and lined up with the outer edge of either the sensor attachment member or the first pad and a protuberant section that has been disposed a portion of a segment in the vicinity of and lined up with the other outer edge. Therefore, there is the advantageous result that the falling off of the sensor attachment plate due to the swinging of the first pad is inhibited. In addition, since the first pad and the sensor attachment member can be manufactured separately, there is the advantageous result that the molding process and the like in the manufacturing is made simple.

In a further embodiment, a rib is disposed standing in the outer edge section of the segments other than the segment in which said latching hole or protuberance in said attachment member has been disposed. Since in the sensor attachment member, in the outer edge section of the segment other than the segment in which the latching hole or the protuberance has been disposed, a rib is disposed standing, rigidity and is imparted to the sensor attachment member. As a result, there is the advantageous result that in those cases where, for example, the first sensor is a vibration sensor, the vibrations due to the striking of the first pad are transmitted to the vibration sensor uniformly and a highly precise detection is performed.

In a further embodiment, said first sensor is attached roughly in the center section of said sensor attachment member. Since the first sensor attached to roughly the center of the sensor attachment member, in those cases where, for example, the first sensor is a vibration sensor, the vibrations due to the striking of the first pad are transmitted uniformly and, in addition, since distance from the shaft that moves up and down is also made a moderate distance, the sensor is not likely to be affected by the vibration of the shaft that moves up and down. Therefore, there is the advantageous result that it is possible for the vibrations due to striking of the first pad to be detected with a high degree of precision.

In a further embodiment, said second pad comprises a third insert-through-hole that is placed in roughly the center of the pad. Moreover, the second pad has a pair of groove sections that protrude toward the outside in the direction of the diameter of the circle and through which said shaft that moves up and down can be inserted. Said second fixing element is furnished with a pedestal member on which said second pad is mounted. A second checking member presses and stops said second pad against said pedestal member in those cases where said second pad is arranged on the pedestal member. Said pedestal member is furnished with a flat section with a portion having a roughly flat surface on which said second pad is installed. A pair of convex portions protrude from the flat section and can mate with said groove. The pedestal members has a fourth insert-through-hole that has a roughly circular shape, is linked to said third insert-through-hole when the convex section and said groove section have been mated, and provides an opening through which said shaft that moves up and down can be inserted.

When the second pad is arranged on the pedestal member by means of the mating of the pair of convex portions that protrude from the flat section of said pedestal member the pair of groove sections that protrude toward the outside of the periphery of the third insert-through-hole in the center portion of said second pad, then the fourth insert-through-hole in said pedestal member and through which it is possible to insert said shaft that moves up and down and said third insert-through-hole through which it is possible to insert said shaft that moves up and down are linked through and, in addition, said second pad is pressed and stopped with respect to said pedestal member by the second checking member. Therefore, it is possible for the second pad to be placed and held such that the pad does not rotate around the pedestal member. In addition to the fact that the pair of convex sections that have been disposed on the pedestal member are mated to the pair of groove sections that protrude toward the outside on the periphery of the third insert-through-hole that has been disposed on the second pad, there is the advantageous result that since the second pad is pressed and stopped against the pedestal member by the checking member, the rotation of the second pad around the third insert-through-hole is inhibited.

In a further embodiment, said second checking member is furnished with a flat plate section having an outer circumference that will not pass through said third insert-through-hole, and a latching section that protrudes from the flat plate section and with which latching of the convex portions of said pedestal member can be done, and a cylindrical section that protrudes from said flat plate section and has an outside diameter that is possible to insert through the linked previously mentioned third insert-through-hole and previously mentioned fourth insert-through-hole, and together with this has a length such that the end portion protrudes from said fourth insert-through-hole side in those cases where the section has been inserted through said third insert-through-hole side, and a male threaded portion that is formed on the cylindrical section at least on the end portion of the side that is separated from a displacement sensor and a female threaded portion that can be screwed onto the male threaded portion.

When the cylindrical section that has been disposed on the second checking member is inserted through from the third insert-through-hole side, the end section on which the male threaded section has been formed protrudes from the fourth insert-through-hole side that is linked through to the third insert-through-hole and by means of the screwing on of the female threaded section, the second checking member presses on and stops the pedestal member of the second pad. In addition, at that time, the latching portion of the second checking member is latched to the convex portion of the pedestal member.

When the cylindrical section that protrudes from the flat plate section of the second checking member is inserted through the third insert-through-hole and the latching section that protrudes from said flat plate section has been latched to the convex section of the pedestal member, the second pad is pressed and stopped against the pedestal member by the second checking member by means of the screwing together of the female threaded section and the male threaded section that protrudes from the fourth insert-through-hole side. In other words, since the second pad is pressed and stopped against the pedestal member by means of a screw fastening format, there is the advantageous result that even if the second pad vibrates during the performance the pressing and stopping force is not reduced and it is possible to reliably inhibit the rotation of the second pad around the third insert-through-hole. In addition, there is also the advantageous result that due to the fact that the second checking member and the pedestal member are made into a single unit, it is possible to more reliably inhibit the rotation of the second pad around the third insert-through-hole.

In a further embodiment, the instrument is furnished with a third sensor that has a sensor sheet member with which the electrical resistance value changes in conformance with the amount of pressing, and a spring member that has a roughly conical shape; and in those cases where the edge section of the wide mouth side is brought into contact with said sensor sheet member and a pressing force that accompanies the displacement due to the lowering of said first pad is applied from the other edge section side, the amount of pressing on said sensor sheet member increases in accordance with the increase in the pressing force, and a case member in which the third sensor is housed, and the outside bottom surface of the case is a flat plate shaped area that has an outer periphery that is not able to pass through said third insert-through-hole in said second checking member.

With the third sensor, when a pressing force is applied to one end of the roughly conical spring member accompanying the dropping down of the first pad, the end section on the wide mouth side, which is the other end that comes into contact with the sensor sheet member, the electrical resistance value of which changes in conformance with the amount of the pressing presses on said sensor sheet. This is accompanied by an increase in the amount of the pressing on said sensor sheet member by the end section of said wide mouth side by the pressing force that follows the dropping down of said first pad. In other words, an increase that follows the amount of the dropping down of said first pad. Incidentally, the outside bottom surface of the case member in which said third sensor is housed is a portion of the second checking member. Since the outside bottom surface of the case section in which the third sensor, with which the amount of displacement of the first pad is detected, also serves as the flat plate section of the second checking member, there is the advantageous result that it is possible to lower the cost by reducing the number of components.

In a further embodiment, said sensor sheet member is disposed long and narrowly in the area that corresponds roughly to the direction of the diameter of the edge portion of the wide mouth side of said spring member, and has a film member for pressing, which has a pressing section that transmits the amount of pressing by said spring member, and a conductive section, which is arranged long and narrowly in a position that corresponds to said pressing section and has electrical conductivity, and the conductive section is furnished with a third film member that is arranged on the surface of the side that is opposite that of said film member for pressing, and an electrode section that is arranged facing the surface of the side that has said conductive section in the third film member and is arranged long and narrowly in a position that corresponds to said conductive section.

When said spring member is pressed, the pressing section on the film member used for pressing that is disposed long and narrowly in the portion that corresponds to roughly the direction of the diameter of the end section on the wide mouth side of the spring member presses the conductive portion that is arranged long and narrowly in a position that corresponds to the pressing section and has electrical conductivity. Here, since the pressing amount due to said spring member is transmitted to said pressing section, the conditions change so that said conductive section and the electrode section that is arranged long and narrowly in a position that corresponds to the conductive section come into contact. As a result, it is possible for the change in the amount of the pressing by said spring member, in other words, the amount of displacement of said first pad, to be detected. Since the amount that the spring member has been pressed by the first pad is transmitted by the pressing section that is disposed long and narrowly, the amount of pressing that has been applied to the spring member is focused and transmitted. Therefore, there is the advantageous result that the precision of the amount of pressing on the spring member that accompanies the dropping down of the first pad is improved.

In a further embodiment, the instrument is furnished with a cylindrical shaped shaft insert-through-tube that is linked in a single unit with said cylindrical section, and together with this, is disposed passing through roughly the center of said sensor sheet member and said spring member viewed from the top and through which said shaft that moves up and down can be inserted. Since the configuration is such that the shaft that moves up and down passes through inside the third sensor via the cylindrical member and the shaft insert-through-tube, the bad effects that can be produced due to bending of the shaft that moves up and down and the like in the detection of the amount of pressing by the third sensor are inhibited. Therefore, there is the advantageous result that a high precision is ensured for the detection precision of the third sensor.

In a further embodiment, said second fixing member is furnished with a pair of first holding sections that are disposed on said pedestal member, and an elastic body arm section that has a portion of the elastic body that is held that can be attached and removed by a holding member and a second holding section with which the arm section can be attached and removed on an axis that is on the same axis as said shaft that moves up and down. Since the section to be held by the second holding section of the elastic body on the arm section of the elastic body that has been disposed on an axis that is on the same axis as the shaft that moves up and down and can be attached and removed is held by the first holding section that has been disposed on the pedestal member so that it can be attached and removed, there is the advantageous result that it is possible to attach the pedestal member that is mounted on the second pad to a shaft that is generally commercially available. In addition, since the arm section and the section to be held comprise the elastic body, they posses bendability and deformability due to pressing. Therefore, since in those cases where the pedestal member is attached, it is possible to accommodate the twisting and the like of the arm section in conformance with the shapes of various types of shafts, there is the advantageous result that the shaft can be attached to the second pad without depending on what type of shaft is generally available commercially.

In a further embodiment, said second pad is roughly a circular dish shape and is furnished within said third insert-through-hole, two wall sections are disposed standing on the rear surface side, which is the surface that faces said first pad, and on the periphery of said third insert-through-hole, excluding at least said groove sections, and in two locations in which the apices are shifted roughly 90 degrees from said groove sections on the arc of said third insert-through-hole, inclined downward toward the two edges from the respective apices.

On the periphery of the third insert-through-hole that is on the rear surface side of the second pad, two locations that are shifted roughly 90 degrees on the arc of said third insert-through-hole from said groove section are made apices. By means of two wall sections that have been disposed sloping downward toward both ends from the respective apices, the direction of the swinging of the second pad is limited to one direction by said wall sections, the direction along said wall section having the apex point of the wall section as a center.

In a further embodiment, the direction in which the respective apices of two wall sections that have been disposed on said second pad are linked and the direction of the groove on the bottom section of said section that has been established on said first pad roughly coincide.

Since the direction that links the respective apices of the two wall sections that have been disposed on said second pad and the direction of the groove on the bottom section of said concave section that has been disposed on said first pad roughly coincide, when the striking surface of the first pad is struck, the first pad and the second pad may swing in roughly the same direction.

In a further embodiment, said first pad is furnished with a first terminal insertion fitting hole on the rear surface side having an opening portion with which it is possible to insert and fit a terminal from the outer periphery, and said second pad is furnished with a second terminal insertion fitting hole on the rear surface side that has an opening portion with which it is possible to insert and fit a terminal from the outer periphery in a location that faces the opening portion of said first terminal insertion fitting hole. Therefore, in those cases where, for example, the terminals of the cables that are linked to the various types of sensor that have been disposed on the first pad and the various types of sensors that have been disposed on the second pad are inserted and fit into the first and second terminal insertion fitting hole, there is the advantageous result that at those times when the first pad and the second pad have been closed, it is possible to accommodate the cables while conserving space.

In a further embodiment, the instrument is furnished with a roughly "L" shaped first terminal section that is inserted and fit into the opening portion of said first terminal insertion fitting hole, and a cable through which it is possible to transmit an electrical signal that is linked to the first terminal section and has flexibility, and a roughly "L" shaped second terminal section that is linked to the other end of the cable and is inserted and fit into said second terminal insertion fitting hole. Since the "L" shaped terminal sections that are disposed on both ends of the cable are inserted and fit into the two terminal insertion fitting holes, even in those cases where the first pad that has been attached to the shaft that moves up and down moves up and down continually, the two terminal sections can rotate in conformance with the movement while they are inserted and fit into the terminal insertion fitting holes. Therefore, there is the advantageous result that the terminal sections are inhibited from falling out of the terminal insertion fitting holes with the pulling of the cable that accompanies the up and down movement of the first pad, and it is possible to lighten the load on the cable and the terminal sections.

In a further embodiment, said first pad and said second pad are roughly circular dish shaped, and said sliding member is disposed on either one of the pads, said first pad or said second pad, and is furnished with a first sliding member that has a roughly arc shaped portion that protrudes from the attachment surface of said pad in the cross-section in the direction of the diameter, and a flat shaped second sliding member that has been disposed on the outer periphery of the other pad in a location that faces the first sliding member, and a second sensor that detects when the arc shaped portion of said first sliding member that protrudes from the attachment surface in the cross-section in the direction of the diameter of said first pad or second pad has come into contact with said second sliding member or has pressed on said second sliding member, and the second sensor is disposed in a location roughly symmetrical with the center in the direction in which the respective apices of the two wall sections that have been disposed on said second pad are linked or on the line segment in the direction of the groove on the bottom section of said concave section that has been disposed on said first pad.

The second sensor is disposed in a location that is roughly symmetrical with respect to the center in the direction of the diameter that is roughly perpendicular to the direction of the swinging of the first pad and the second pad. Therefore, the second sensor is arranged in the most insensitive location with respect to the swinging movement of the first pad and the second pad, there is the advantageous result that in those cases where, for example, the second sensor is a sensor for the detection of a closed state between the first pad and the second pad, it is possible to prevent erroneous operation due to the swinging movement.

In a further embodiment, said second pad is furnished with a third terminal insertion fitting hole on the obverse surface side that roughly coincides with the direction in which the respective apices of the two wall sections that have been disposed on said second pad are linked and with which it is possible to insert and fit a terminal from the outer periphery side. The third terminal insertion fitting hole, with which a terminal can be inserted and fit from the outer periphery side, may be disposed in a direction that coincides with the direction that links the respective apices of the two wall sections on the obverse surface side of the second pad, in other words, the direction of the diameter that is roughly perpendicular to the direction of the swinging of the second pad. That is to say, since the third terminal insertion fitting hole is disposed in a roughly perpendicular direction with respect to the direction of the swinging of the second pad, there is the advantageous result that in those cases where the terminal of the cable has been inserted and fit into the third terminal insertion and fitting hole, it is possible to prevent the dropping out of the terminal due to the swinging movement of the second pad.

In a further embodiment, a pad having a striking surface comprising an elastic body is fixed to a shaft, said pad is furnished with a first insert-through-hole that has been disposed in roughly the center portion and through which it is possible to insert said shaft, and a concave section that has a groove shaped bottom portion on the rear surface that is the reverse side of said striking surface and that crosses through roughly the center portion of said first insert-through-hole, and the instrument is furnished with a rotation stopping member, which is fit to the concave section so that there is play, that is furnished with a peaked section having an apex that is shaped in conformance with the groove shaped bottom section on said concave section, and a second insert-through-hole that is disposed in a location that corresponds to said first insert-through-hole in those cases where the rotation stopping member has been fit to said concave section so that there is play and through which it is possible to insert said shaft, and together with this, has a outer periphery that cannot pass through said first insert-through-hole, and a cylindrical member that is fixed as a single unit with the rotation stopping member and, together with this, protrudes from said peaked section side of said second insert-through-hole, and has a male threaded section on a portion of the outer periphery; and it is possible for said shaft to be inserted through; and, together with this, it is possible to insert through said first insert-through-section, and has a length that protrudes from said first insert-through-section in those cases where said rotation stopping member has been fit to said concave section so that there is play, and a checking member that is furnished with a female threaded section that can be screwed onto said male threaded section, and in those cases where said rotation stopping member has been fit to said concave section so that there is play, said female threaded section is screwed onto said male threaded section and presses on said pad, and said pad is pressed against said rotation stopping member and stopped, and a pad fixing member that is disposed in a single unit with the front end of said cylindrical member and fixes said pad to said shaft that has been inserted through said first insert-through-hole.

When a rotation stopping member is fit to the concave section that has been established on the rear surface, which is the back side of the striking surface of the pad, so that there is play, the apices of the peaked sections of said rotation stopping member that have a shape that corresponds to the groove of the bottom section of said concave section are arranged in said groove and, in addition, said pad is pressed and stopped against said rotation stopping member by the checking member. Therefore, with said rotation stopping member that has been fit to the concave section of said first pad so that there is play, the apex on the peaked section of said rotation stopping member becomes a fulcrum, said first pad is made to swing in one direction like a balance scale and together with this, prevents the rotation with said apex as an axis.

Here, said groove is disposed such that the cross-section passes through roughly the center portion of the first insert-through-hole that has been disposed roughly in the center section of said pad and together with this, in those cases where said rotation stopping member has been fit to said concave section so that there is play, said first insert-through-hole and the second insert-through-hole that has been disposed on said rotation stopping member are disposed in locations that are mutually corresponding. Therefore, in those cases where said rotation stopping member has been fit to said concave section so that there is play, the shaft that moves up and down is inserted through roughly the center of said pad. When the shaft that moves up and down is inserted through roughly the center of said pad, since said pad is fixed to said shaft that moves up and down by the pad fixing member, said pad is prevented from rotating with said shaft that moves up and down as the center.

In addition, in those cases where said rotation stopping member has been fit to said concave section so that there is play, since the cylindrical member that has been fixed to said rotation stopping member to form a single unit protrudes from said first insert-through-hole, said pad is pressed and stopped against said rotation stopping member by the screwing together of the male threaded section that is disposed on a portion of the outer periphery of the cylindrical member and the female threaded section.

When the rotation stopping member is fit to the concave section that has been disposed on the rear surface of the pad so that there is play, since the pad can swing in one direction without rotating around the rotation stopping member due to the shapes of the groove on the bottom section of the concave section and the apex of the peaked section of the rotation stopping member, there is the advantageous result that it is possible to limit the striking surface portion on the pad. In addition, in those cases where the rotation stopping member has been fit to the concave section that has been disposed on the rear surface of the pad, the pad is pressed and stopped against the rotation stopping member by the screwing of the female threaded section to the male threaded section of the cylindrical member that protrudes from the pad. Since the cylindrical member is fixed to the rotation stopping member to form a single unit and, in addition, the pad is pressed and stopped by means of a screw fastening format, there is the advantageous result that the pad can be pressed and stopped against the rotation stopping member with an appropriate pressing and stopping force and together with this, there is the advantageous result that it is possible to inhibit the rotation of the pad around the shaft that would accompany a loosening of the threads and a reduction of the pressing and stopping force even when the pad swings.

BRIEF DESCRIPTION OF THE DRAWINGS

FIG. 8(*a*) is a detailed drawing of the close switch;

FIG. 8(*b*) is a cross-sectional view of the C-C portion of the close switch in FIG. 8(*a*).

FIG. 12(*a*) is a drawing that shows a state in which a coil spring has been pressed slightly;

FIG. 12(*b*) is a drawing that shows a state in which a coil spring has been pressed further than the state shown in 12(*a*); and FIG. 12(*c*) is a drawing that shows a state in which a coil spring has been pressed further than the state shown in 12(*b*);

DESCRIPTION OF PREFERRED EMBODIMENTS

Figure 1:
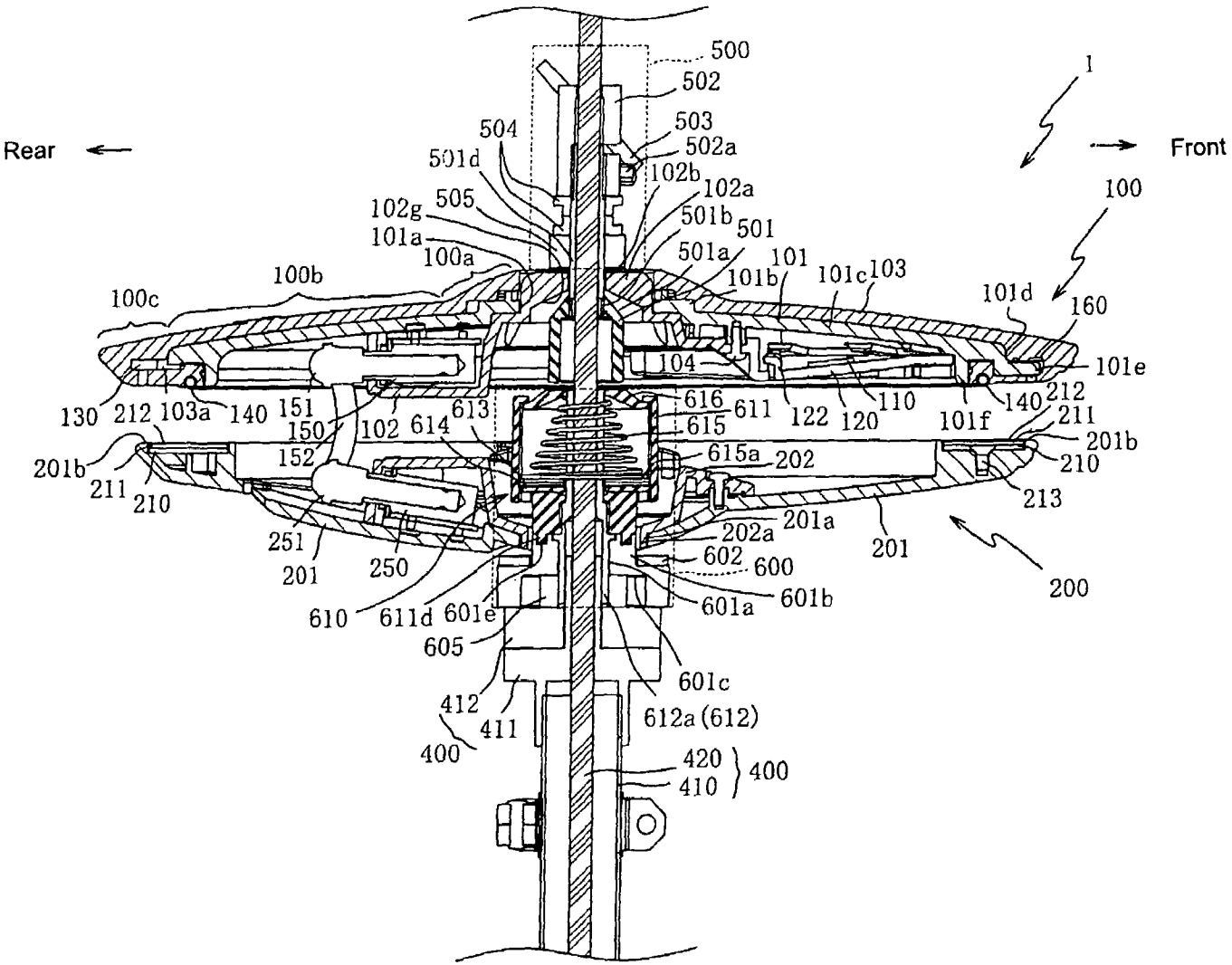
FIG. 1 is a front to back cross-sectional view of an electronic HiHat cymbal of an embodiment of the invention, showing a first and a second cymbal pad of the electronic HiHat cymbal in an open state.

Embodiments of the present invention are described in detail with reference to the attached drawings. FIG. 1 is a front to back cross-sectional view of an electronic HiHat cymbal 1, which is an electronic percussion instrument. A top cymbal pad section 100 and a bottom cymbal pad section 200 are in an open state. The cross-section in FIG. 1 follows lines A'-A' in FIG. 4 and A"-A" in FIG. 6 that are both discussed later.

Figure 2:
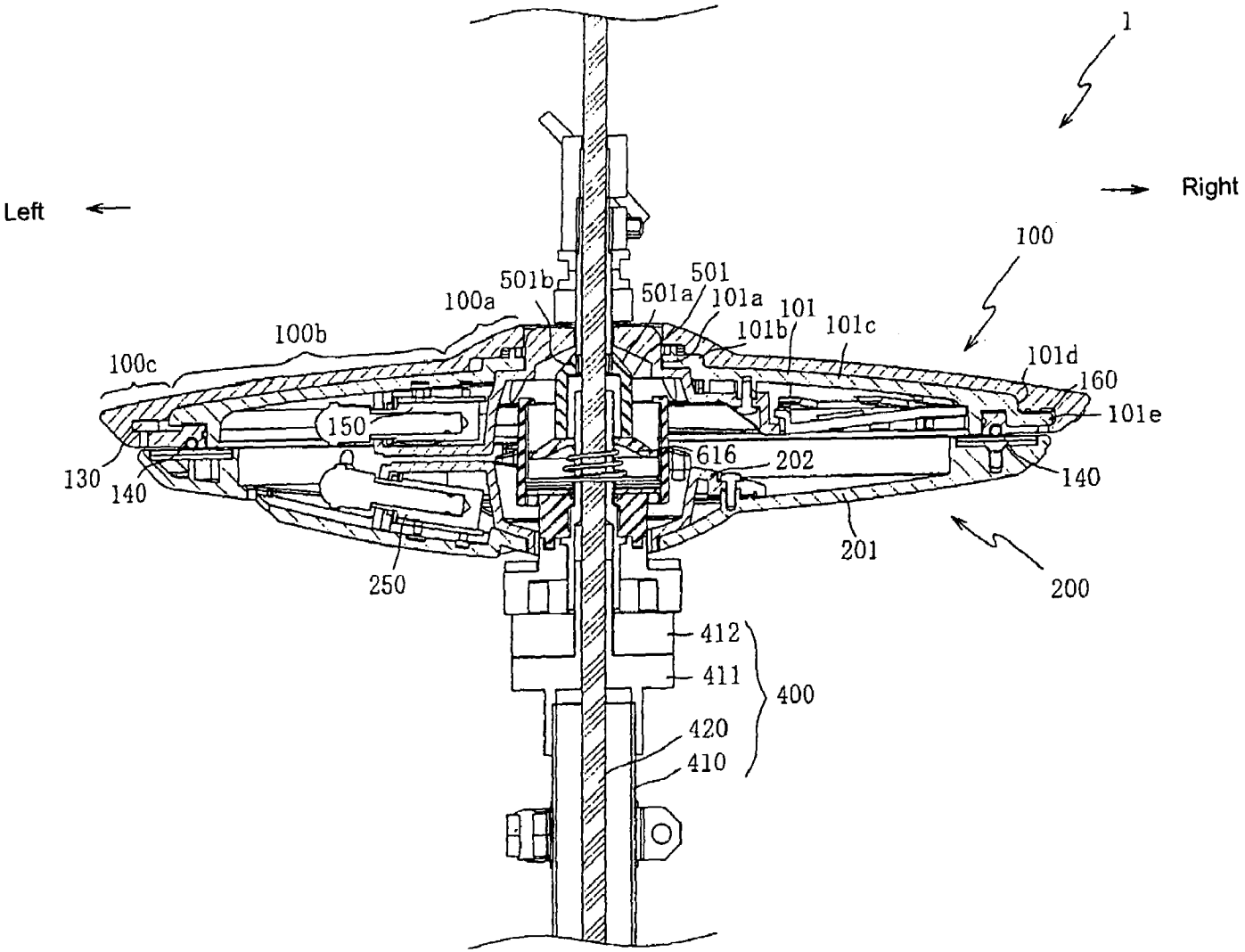
FIG. 2 is a front to back cross-sectional view of an electronic HiHat cymbal of the embodiment in FIG. 1, showing a first and a second cymbal pad of the electronic HiHat cymbal in a closed state.

In addition, FIG. 2 is a front to back cross-section along the same line as in FIG. 1 in a case when the top cymbal pad section 100 and the bottom cymbal pad section 200 are in a closed state.

Figure 3:
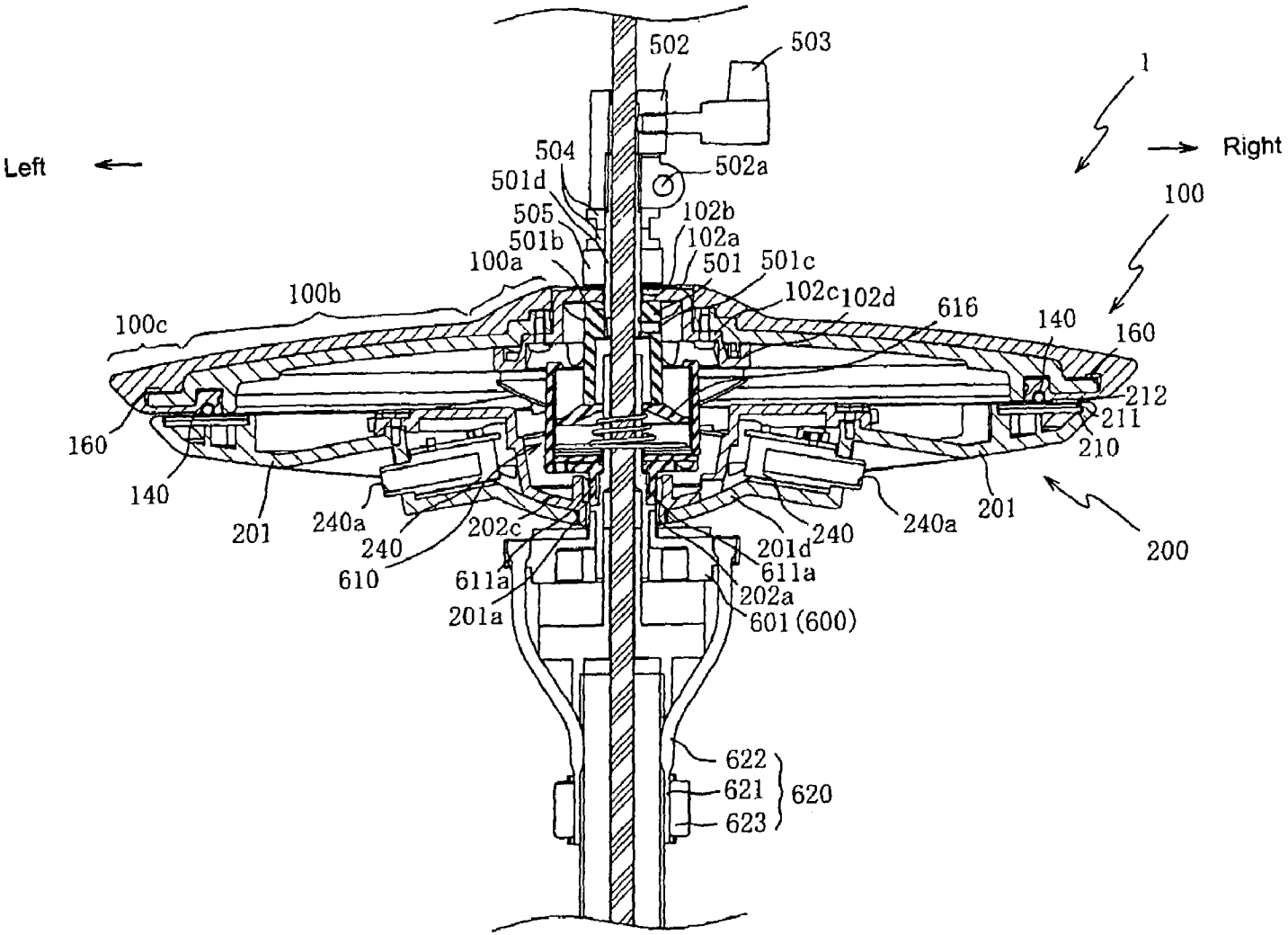
FIG. 3 is a left to right cross-sectional view of an electronic HiHat cymbal of the embodiment in FIG. 1, showing a first and a second cymbal pad of the electronic HiHat cymbal in a closed state.

Furthermore, FIG. 3 is a cross-section of the top cymbal pad section 100 and the bottom cymbal pad section 200 that are in a closed state. The cross-section passes through the center of the two pads in a right-to-left direction perpendicular to the cross section of FIG. 1. The cross-section follows lines B'-B' in FIG. 4 and B"-B" in FIG. 6 that are both discussed later.

The "front" side of the electronic HiHat cymbal 1 is the side that faces a performer of the electronic HiHat cymbal 1. It is the side of the top cymbal pad section 100 that is struck by the performer. The "back" side of the electronic HiHat cymbal 1 is the opposite side with respect to the center of the top cymbal pad section 100. In FIG. 1 and FIG. 2, the "front" side of the electronic HiHat cymbal 1 is shown on the right side of the page, and the "back" side is shown as the left side of the page.

In addition, the "right" side of the electronic HiHat cymbal 1 is the right side of the electronic HiHat cymbal 1 as viewed by the performer. The "left" side means the left side of the electronic HiHat cymbal 1 as viewed by the performer. In FIG. 3, the "right" side of the electronic HiHat cymbal 1 is shown on the right side of the page, and the "left" side is shown on the left side of the page.

The electronic HiHat cymbal 1 comprises, as shown in FIG. 1 through FIG. 3, a top cymbal pad section 100, which is the pad that may be struck by the performer using a stick and the like; a bottom cymbal pad section 200 that is placed below the top cymbal and faces the top cymbal pad section 100; a stand section 400 that supports the top cymbal pad section 100 and the bottom cymbal pad section 200; a first fixing element 500 with which the top cymbal pad section 100 is fixed to an extension rod 420; a second fixing element 600 with which the bottom cymbal pad section 200 is fixed to a hollow shaft 410 of the stand section 400, etc.

The stand section 400 has a structure that may be the same as that of a stand used for a typical HiHat cymbal. It has a hollow shaft 410 with which the height of the bottom cymbal pad section 200 can be adjusted. It also has an extension rod 420 that is inserted through the hollow shaft 410 and that is moved up and down in conformance with the operation of a foot pedal that is not shown in the drawing, etc. The stand section 400 is further furnished with legs and the like, which are not shown in the drawing. The legs and the like are attached to the lower part of the hollow shaft 410. They support the stand section 400 in a standing up position.

In order to stabilize the bottom cymbal pad section 200, a felt holding section 411 and a lower felt washer 412 are placed on the top end of the hollow shaft 410. The bottom cymbal pad section 200 is fixed by a second fixing element 600 so that the pad can pivot on the top side of the lower felt washer 412. The top cymbal pad section 100 is fixed with a first fixing element 500 at a specified location on the extension rod 420 so that the pad can swing. An example of a manner of fixing this kind of top cymbal pad section 100 and bottom cymbal pad section 200 to the stand section 400 is discussed later.

Figure 4:
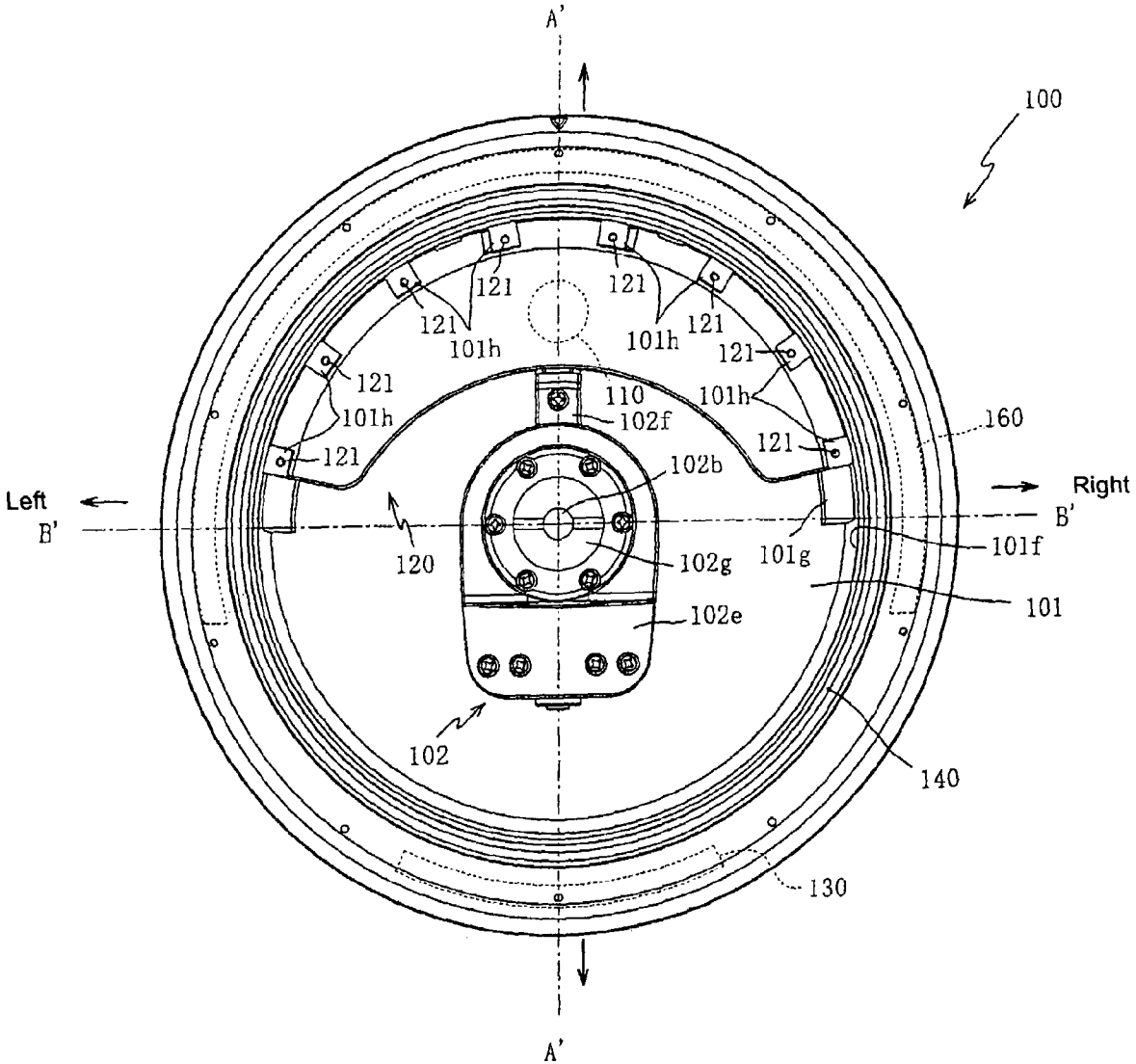
FIG. 4 is a drawing of the rear surface side of a top cymbal pad section of the embodiment of FIG. 1.
Figure 5:
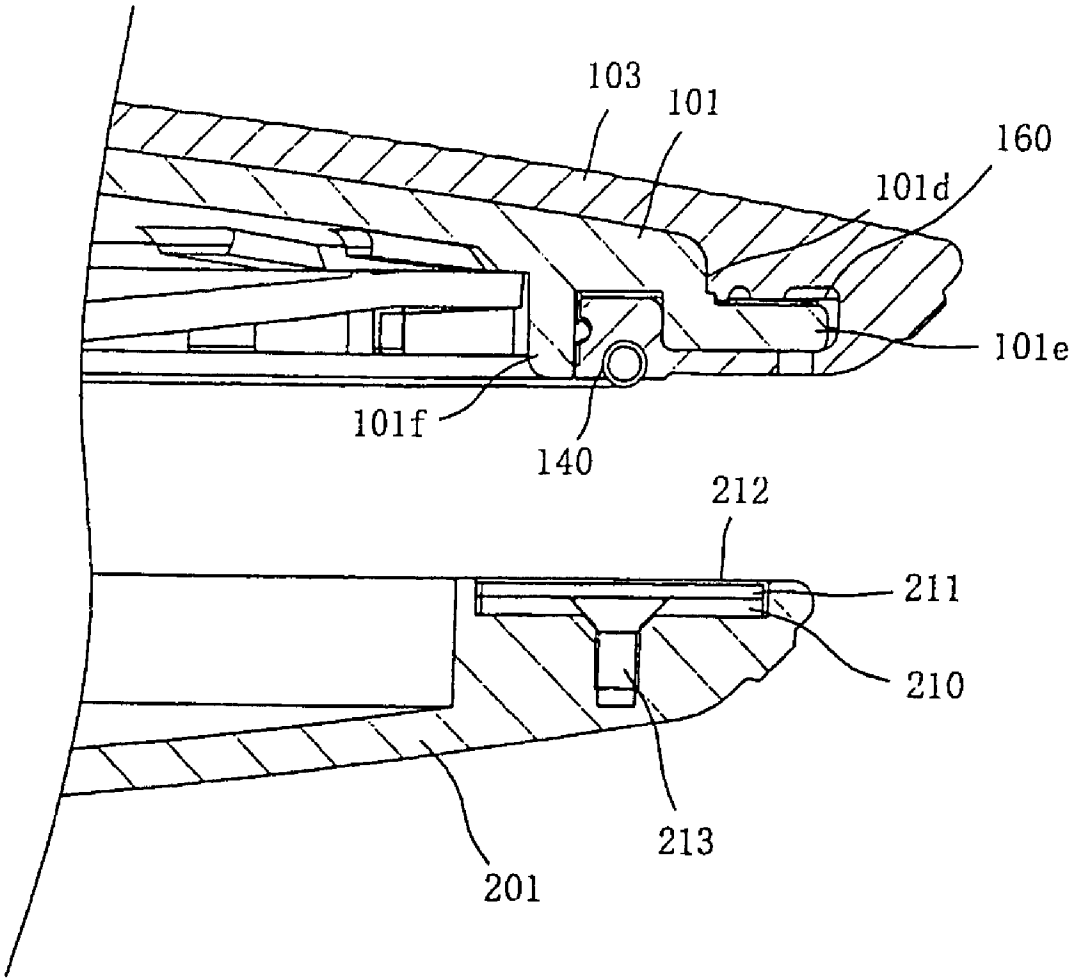
FIG. 5 is a cross-sectional view of a peripheral section of a top and a bottom cymbal pad of an embodiment of an electronic HiHat cymbal including an edge sliding tube and an edge sliding film.

An explanation of the structure of the top cymbal pad section 100 in reference to FIG. 4 and FIG. 5, and FIG. 1 through FIG. 3, is given below. FIG. 4 is a front view of the lower surface side of the top cymbal pad section 100. FIG. 5 is a drawing of the peripheral section of the top cymbal pad section 100 and the bottom cymbal pad section 200 including an edge sliding tube 140 and an edge sliding film 212 respectively. In this embodiment, a "top surface of the top cymbal pad section 100" and a "bottom surface of the top cymbal pad section 100" refer to the top surface and the bottom surface respectively of the top cymbal pad section 100 and the bottom cymbal pad section 200 that are attached to the stand section 400.

The top cymbal pad section 100 has a roughly circular top surface side or a bottom surface side that has a cup section 100*a*. The cup section 100*a* has a dome shape in the vicinity of center of the top surface side. The top cymbal pad section 100 also comprises an edge section 100*c*, which is the outer peripheral edge of the top cymbal pad section 100, and a bow section 100*b* that is between the edge section 100*c* and the cup section 100*a*.

The top cymbal pad section 100, as shown in FIG. 1, comprises a first top frame 101 that forms a skeleton, a cover 103 with which the first top frame 101 is covered, a second top frame 102 that has an insert-through-hole 102*b* through which the extension rod 420 is inserted, and a vibration sensor attachment frame 120. The vibration sensor attachment frame 120 is used for attaching a vibration sensor 110 such as, for example, a piezo element.

The cover 103 is formed from an elastic body such as rubber or elastomer that covers the top surface side of the top cymbal pad section 100 and a portion of the bottom surface side such as the edge section 100*c* and the like. The cover 103 allows the top cymbal pad section 100 to have a more raised cup section 100*a* and an uniformly flat bow section 10*b*, and an edge section 100*c*. Moreover, the top surface side of the top cymbal pad section 100 has concentric circular convexo-concave pattern that is not shown in the drawing. For example, it may have a convexo-concave pattern with a groove width of 2 mm, a pitch of 4 mm (width from groove to groove), and a depth of 0.1 mm.

In addition, a primer (a reactive surface quality improving treatment agent) for rubber and the like is used as a coat on the top surface side portion of the cover 103 using a method such as dipping, brush coating, spraying, etc. Thus, the quality of the surface is improved. The improved quality of the surface allows the stick that is used to strike the top cymbal pad section 100 to slide more easily. Accordingly, the sensation of striking the stick on the top cymbal pad section 100 becomes closer to the striking sensation of an acoustic metal cymbal being struck. Moreover, the quality of the surface further increases the abrasion resistance of the cover 103. The abrasion of the cover 103 due to striking over a long period of time can be decreased. When the top surface side of a top cymbal pad section 100 covered with a cover 103 is struck, the bouncing of the stick becomes a more natural bounce similar to a bounce when an acoustic cymbal is used.

The first top frame 101 is a frame that has been molded from a hard plastic material such as acrylonitrile butadiene styrene (ABS) resin or polycarbonate resin and the like. The frame is furnished with an opening section 101*a* in its center and when viewed from above, has a circular plate shape.

The first top frame 101, as shown in FIG. 1, has a shoulder section 101*b*, which is at the periphery of the opening section 101*a*. The first top frame 101 also has an arm section 101*c*, which extends from the shoulder section 101*b* toward the outer periphery. In addition, the top cymbal pad section 100 comprises a step 101*d* on the outer periphery side of the arm section 111*c* and an outer peripheral section 101*e* that is located a level lower than the step 101*d*.

With regard to the front semicircle of the top cymbal pad section 100, as a result of the step 101*d* and the outer peripheral section 101*e*, the cover 103 that covers the top of the outer peripheral section 101*e* is thicker in those areas. Therefore, the vibrations of the first top frame 101 that result from the striking of the top cymbal pad section 100 are uniform and vibrations of the outer peripheral section 101*e* become suppressed. Accordingly, even when the top cymbal pad section 100 is struck repeatedly, it is possible to accurately detect the striking location and the striking force of each strike.

In addition, since the cover 103 extends further towards the perimeter from the outer peripheral section of the first top frame 101*e*, the edge section 100*c* is easily deformed. Because of this, it is possible to reproduce the sensation of the deformation due to striking an acoustic cymbal. The absorption of the impact by the edge of an acoustic cymbal can also be reproduced.

On the other hand, the back semicircle of the first top frame 101 has no step such as step 101*d* and no outer peripheral section such as the outer peripheral section 101*e*. Thus, the radius of the back semicircle may be shorter than the radius of the front semicircle. Therefore, the back semicircle of the top cymbal pad section 100, as shown in FIG. 1, may be formed primarily by the elastic body that configures the cover 103.

The back semicircle of the top cymbal pad section 100 formed primarily from an elastic material, creates a hollow section 103*a*. The hollow section 103*a* has a roughly circular arc shape that is roughly parallel to the outer periphery of the top cymbal pad section 100 as viewed from above. A weight 130 made of plate shaped metal and having a roughly circular arc shape when viewed from above is placed within the hollow section 103*a*. Thus, the weight 130 is enclosed within the hollow section 103*a*. The weight 130 is used to balance the weight of the vibration sensor attachment frame and the like that are installed in the front of the top cymbal pad section 100.

In addition, a wall 101*f* that is located further inside from the outer periphery of the arm section 101*c* is placed on the lower surface side of the first top frame 101 (the side that faces a bottom cymbal pad section 200). In the roughly circular region that is surrounded by the wall 101*f*, there are components related to the generation of musical tones by the electronic HiHat cymbal 1. Some of those components are a vibration sensor attachment frame 120 that is furnished with a vibration sensor 110, a stereo jack 150 for linking and outputting signals that are detected by the vibration sensor 110 and an edge sensor 160 that runs from the top cymbal pad section 100 side to the bottom cymbal pad section 200 side.

On the bottom side of the cover 103 (the side that faces the bottom cymbal pad section 200), as shown in FIG. 4, a roughly toroidal edge sliding tube 140 is mounted so that it is roughly parallel to the outer periphery of the top cymbal pad section 100 as viewed from above. The edge sliding tube 140 is a component that promotes the gliding contact between the top cymbal pad section 100 and the bottom cymbal pad section 200. When the top cymbal pad section 100 vibrates as a result of being struck, the vibrations of the top cymbal pad section 100 are transmitted through a contact portion between the top cymbal pad section 100 and the bottom cymbal pad section 200 to the bottom cymbal pad section 200. The bottom cymbal pad section vibrates in response. The sliding mechanism using the edge sliding tube 140 is discussed later.

The edge sliding tube 140 has superior sliding qualities and abrasion resistance material properties. It may comprise a synthetic resin tube such as a nylon or TEFLON. The tube may have a roughly circular shape in the cross-section in the direction of the width. Using nylon in manufacturing the edge sliding tube 140 is a cost-efficient option.

In addition, since the edge sliding tube 140 comprises a tube material with a roughly circular cross-section in the direction of the width, the contact area between the edge sliding tube 140 and the bottom cymbal pad section 200 (in particular, an edge sliding film 212 discussed later) can be kept small. The sliding properties in the sliding mechanism discussed later are favorable.

The edge sliding tube 140 is placed so that when the electronic HiHat cymbal 1 is in a closed state, the location of the edge sliding tube 140 on the lower surface side of the top cymbal pad section 100 preferably corresponds to the center (or approximately centered) along the width of the edge sliding film 212 that has been placed on an upper surface 201*b* of an edge section of the bottom cymbal pad section 200. Therefore, when the top cymbal pad section 100 and the bottom cymbal pad section 200 vibrate back and forth and left and right due to striking, it is possible to ensure a maximum sliding (movement) distance by using the edge sliding tube 140 and the edge sliding film 212 as a sliding mechanism.

A groove (not shown in the drawing) that may have a roughly toroidal shape may be used to attach the edge sliding tube 140 to the top cymbal pad section 100. The groove is in the cover 103 that covers the lower surface side of the top cymbal pad section 100. The edge sliding tube 140, which is ring shaped, may be inlaid in the groove.

The edge sliding tube 140 is attached so that at least a portion of its circular arc protrudes from the surface of the cover 103 along the cross-section in the direction of the diameter of the top cymbal pad section 100 (refer to FIG. 5). In embodiments in which the edge sliding tube 140 is placed so that a major part of it is in the cover 103, a dislocation of the edge sliding tube 140 from the top cymbal pad section 100 can be prevented. For further stability of the structure, a portion of the edge sliding tube 140 may be adhered to the cover 103 with an adhesive.

A second top frame 102 is a frame made out of an elastic body that comprises a more flexible material than the material of the first top frame 101. An example of such material is rubber. As shown in FIG. 3, the second top frame 102 has a head section 102*a* that protrudes upward from the opening section 101*a* in the center of the first top frame 101, a shoulder section 102*c* that holds the lower surface peripheral edge of the opening section 101*a* from the bottom side, and an arm section 102*d* that holds the portion that corresponds to the bow section 100*b* on the first top frame 101 from the bottom side.

In addition, as shown in FIG. 4, a case section 102*e* houses the stereo jack 150, and a wiring holder 102*f*, which protects the wiring connected to the vibration sensor 110. The case section 102*e* fits within the vibration sensor attachment frame 120. Thus, the case section 102*e* and the vibration sensor attachment frame 120 can be viewed as a single unit. The second top frame 102 is attached to the first top frame 100 by a screw 104.

An insert-through-hole 102*b* is placed in the center of the head section 102*a* of the second top frame 102 so that the extension rod 420 can be passed through. In addition, on the periphery of the insert-through-hole 102*b*, and on the bottom surface of the head section 102*a* of the second top frame 102, there is a concave section 102*g*. As shown on FIG. 4, the concave section 102*g* has a groove-shaped bottom section that runs from the left to the right (corresponding to the left to right direction of the page in FIG. 4) of the top cymbal pad section 100. A rotation stopping member 501, which is discussed later, is fit to the concave section 102*g* so that there is play. The rotation stopping member 501 may comprise tapered member having a rounded taper that engages the rounded concavity of concave section 102*g* and having an elongated apex forming a ridge that engages and fits in the elongated groove in the groove-shaped bottom section of the concave section 102*g*. When the top cymbal pad section 100 has been struck, the pad vibrates but rotation is prevented by the shape of the concave section 102*g* and the shape of the rotation stopping member 501.

Since it is possible to limit the striking surface to the front of the top cymbal pad section 100 by a rotation prevention mechanism such as that mentioned above, it is sufficient to place the vibration sensor attachment frame 120 for attaching the vibration sensor 110 that detects the vibrations at the time of striking in a specified region of the front semicircle. There is no need to place sensors all around the entire periphery of the top cymbal pad section 100.

The vibration sensor attachment frame 120 is, as shown in FIG. 4, a plate shaped member that has an outer periphery that is along the wall 101*f* of the first top frame 101. The vibration sensor attachment frame 120 is inserted between the shoulder section 101*g* that is placed in the front semicircle (the top of the page in FIG. 4) of the first top frame 101 and a plurality of latching sections 101*h*. The latching sections 101*h* protrude from the wall 101*f* that is separated from the shoulder section 101*g* so that it is possible to insert the vibration sensor attachment frame 120. In addition, the frame is latched and attached to the top cymbal pad section 100 by the mating of the protuberant sections 121 that are lined up on the vibration sensor attachment frame 120 and latching holes (not shown in the drawing) that are placed in the corresponding latching sections 101*h*. On the other hand, the free end of the vibration sensor attachment frame 120 that is not latched by the protuberant sections 121, is thick and has a rib 122 that is standing and possesses rigidity. Thus, since the vibration sensor attachment frame 120 is attached to the top cymbal pad section 100, a portion of the outer periphery is latched along the wall 101*f*, and the free end is rigid, it is possible that both the top cymbal pad section 100 and the first top frame 101 vibrate together when the top cymbal pad section 100 is struck.

The vibration sensor is placed roughly in the center of the surface of the vibration sensor attachment frame 120 on the side that faces the first top frame 101. As described above, because the vibration sensor attachment frame 120 is a single unit that vibrates with the first top frame 101, the vibration sensor 110 that is attached on the vibration sensor attachment frame is precise in detecting the vibrations at the time the top cymbal pad section 100 is struck. Therefore, it is possible to detect the striking force and striking position of the top cymbal pad section 100 with good precision.

In addition, since the vibration sensor 110 is not attached directly to the first top frame 101, but rather is attached via the vibration sensor attachment frame 120 separated from the first top frame 101, the vibration sensor is not struck directly when the top cymbal pad section 100 is struck. Therefore, the vibrations can be made uniform and can be transmitted regardless of where on the striking surface the top cymbal pad section 100 has been hit. Accordingly, the vibration detection sensitivity at the time the top cymbal pad section 100 is struck can be made uniform.

Furthermore, since the vibration sensor 110 is separated from the first top frame 101 by the vibration sensor attachment frame 120 and is also placed in roughly the center section of the vibration sensor attachment frame, the vibration sensor 110 is separated a suitable distance from the extension rod 420 that is inserted through the center of the top cymbal pad section 100. Therefore, the sensitivity toward the impact and vibrations from the extension rod 420 that accompany the opening and closing actions resulting from pedal operations at the time of the performance is low. Thus, the detection sensitivity of the vibrations due to the striking of the top cymbal pad section 100 is improved.

In addition, as shown in FIG. 1 and FIG. 4, an edge sensor 160 is provided on the top side of the outer peripheral section 101*e* of the first top frame 101, which is in the front semicircle of the top cymbal pad section 100. The edge sensor 160 is a pressure sensitive sensor that detects the striking of the edge section 100*c*. As previously discussed, due to the fact that the top cymbal pad section 100 is configured to prevent rotation, the edge sensor 160 may be attached only in the front semicircle portion that is the striking surface of the top cymbal pad section 100. Thus, the manufacturing costs can be reduced.

Next, an explanation will be given regarding the first fixing element 500 that fixes the top cymbal pad section 100 and a stand section 400. As shown in FIG. 1, the first fixing element 500 comprises a rotation stopping member 501 that is placed on the bottom of the head section 102*a* of the second top frame 102; a clutch top 502 that is placed on the top of the head section 102*a* of the second top frame 102; a clutch screw 503, which may be a butterfly bolt; two lock nuts 504; and an upper felt washer 505.

The rotation stopping member 501 is, as discussed before, a member that is fit to the concave section 102*g* that is placed on the inside center section of the head section 102*a* so that there is play. The rotation stopping member 501 has a convex section (a front end section 501*a*) with a shape that corresponds to and fits into the concave section 102*g*. It also comprises a cylindrical member such as a pipe section 501*d* that has a cylindrical portion with an outer diameter that is larger than the insert-through-hole 102*b* and that extends along the center of the end section 501*a*. One end of the pipe section 501*d* is inserted through the opening section 501*b* that is placed roughly in the center section on the end section 501*a* of the rotation stopping member 501. The pipe section 501*d* is screwed on with a screwing member that is not shown in the drawing. In addition, the pipe section 501*d* is fixed to the rotation stopping member 501 with a set screw. Thus, the pipe section 501*d* and the rotation stopping member 501 form a single unit.

When the pipe section 501*d* of the rotation stopping member 501 is inserted through the insert-through-hole 102*b* that is roughly in the center of the top cymbal pad section 100 and fit to the concave section 102*g* of the end section 501*a* so that there is play, the convex section of the end section 501*a* is in contact with the groove shape on the bottom section of the concave section 102*g*. Thus, it becomes possible for the top cymbal pad section 100 to swing like a balance scale with the end section 501*a* as a pivot.

When the pipe section 501*d* is inserted through the insert-through-hole 102*b*, the pipe section protrudes from the top of the top cymbal pad section 100. The upper felt washer 505, is a washer made of felt. The upper felt washer 505, the two lock nuts 504, and the clutch top 502 are arranged in this order from the bottom of the pipe section 501*d* that protrudes from the top of the top cymbal pad section 100. A threaded groove that is not shown in the drawing is placed in the region around the area in which the two lock nuts 504 are located. The manner in which the top cymbal pad section 100 is pressed on by the upper felt washer 505 can be adjusted by screwing the lock nuts 504 into the threaded groove. In addition, since the lock nuts 504 press the top cymbal pad section 100 against the rotation stopping member 501, the lock nuts 504 will not become loose even when the top cymbal pad section 100 swings and vibrates during the performance. Hence, the pressing force of the top cymbal pad section 100 is not likely to be reduced. In particular, the loosening of the lock nuts 504 can be more effectively prevented by the use of two lock nuts 504.

Because the upper felt washer 505 moderately presses the top cymbal pad section 100 onto the rotation stopping member 501 from the top, the convex section of the end section 501*a* is fit to the groove of the concave section 102*g* so that there is play. In this case, the convex section of the end section 501*a* and the groove of the concave section 102*g* extend along one axis, which can be designated as a left-to-right axis. The convex section of the end section 501*a* and the groove of the concave section 102*g* are limited to the left to right direction of the top cymbal pad section 100. Thus, if, for instance, the top cymbal pad section 100 is struck on the front side, the swinging motion is in the single direction of left to right like a balance scale. Furthermore, the rotation of the top cymbal pad section 100 with the rotation stopping member 501 as the center is prevented.

The clutch top 502 that is placed on top of the lock nuts 504 is fixed to the end section of the pipe section 501*d* by the clutch bolt 502*a*. The upper end of the pipe section 501*d* is placed so that it is lower than a screw hole (not shown in the drawing) for screwing the clutch screw 503. The screw hole is located on the upper section of the clutch top 502.

After the first fixing element 500 has been attached to the top cymbal pad section 100 in the manner described above, the extension rod 420 is inserted into the pipe section 501*d* from the bottom side of the top cymbal pad section 100. Then, by placing the top cymbal pad section 100 at a suitable height and tightening the clutch screw 503, the top cymbal pad section 100 is fixed onto the extension rod 420 so that the pad will not rotate around that axis.

Accordingly, when the top cymbal pad section 100 is fixed to the extension rod 420 with the first fixing element 500, which is configured as described above, the top cymbal pad section 100 swings without rotating around the axis of the extension rod 420 or around the rotation stopping member 501.

Since the extension rod 420 is inserted through the pipe section 501*d*, the shaking of the extension rod 420 and the like is not transmitted directly to the top cymbal pad section 100. Thus, it is possible for the vibration sensor 110 to detect less noise generated from the shaking and the like of extension rod 420.

Figure 6:
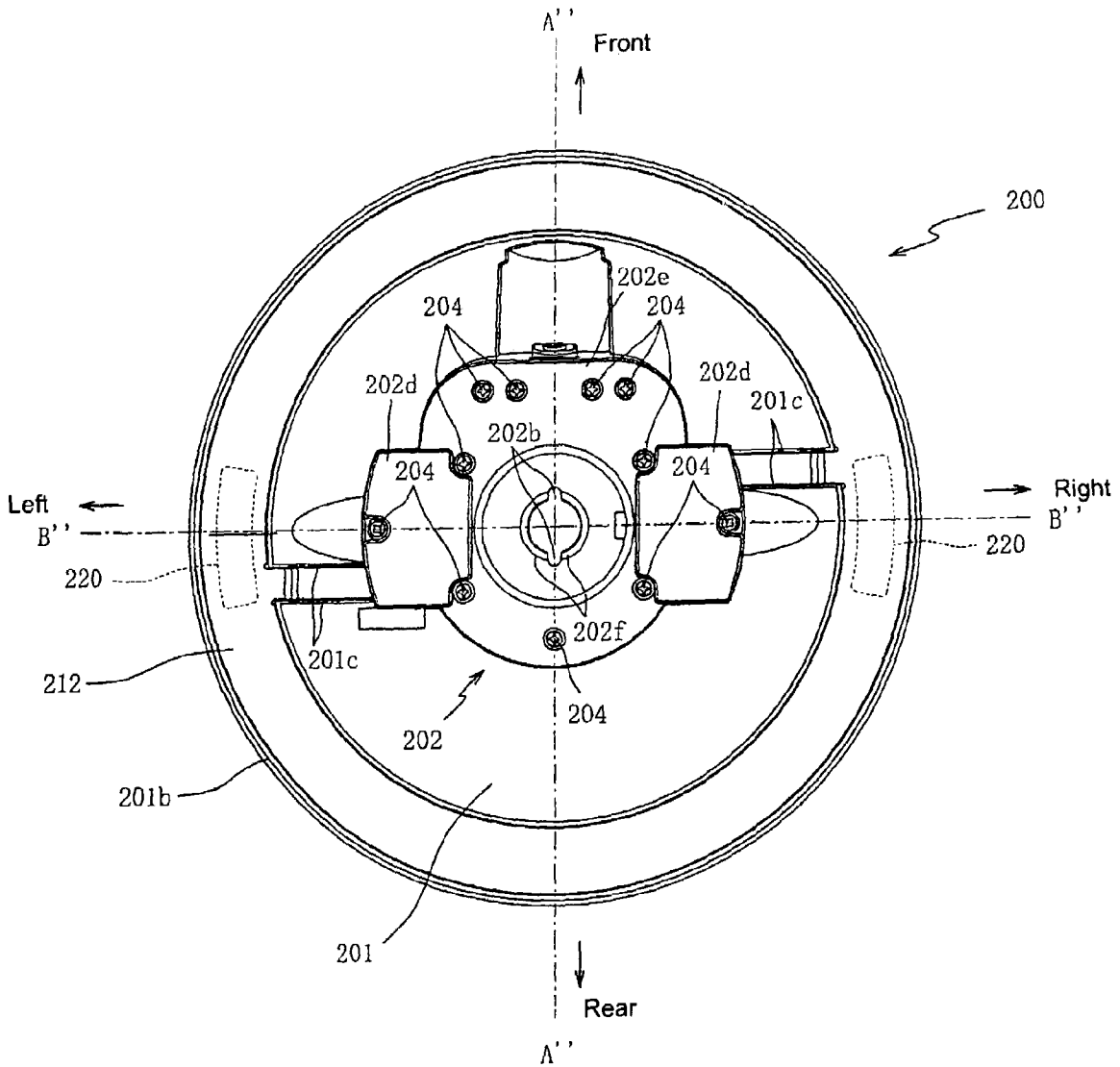
FIG. 6 is a drawing of the rear surface side of a bottom cymbal pad section of the embodiment of FIG. 1.
Figure 7:
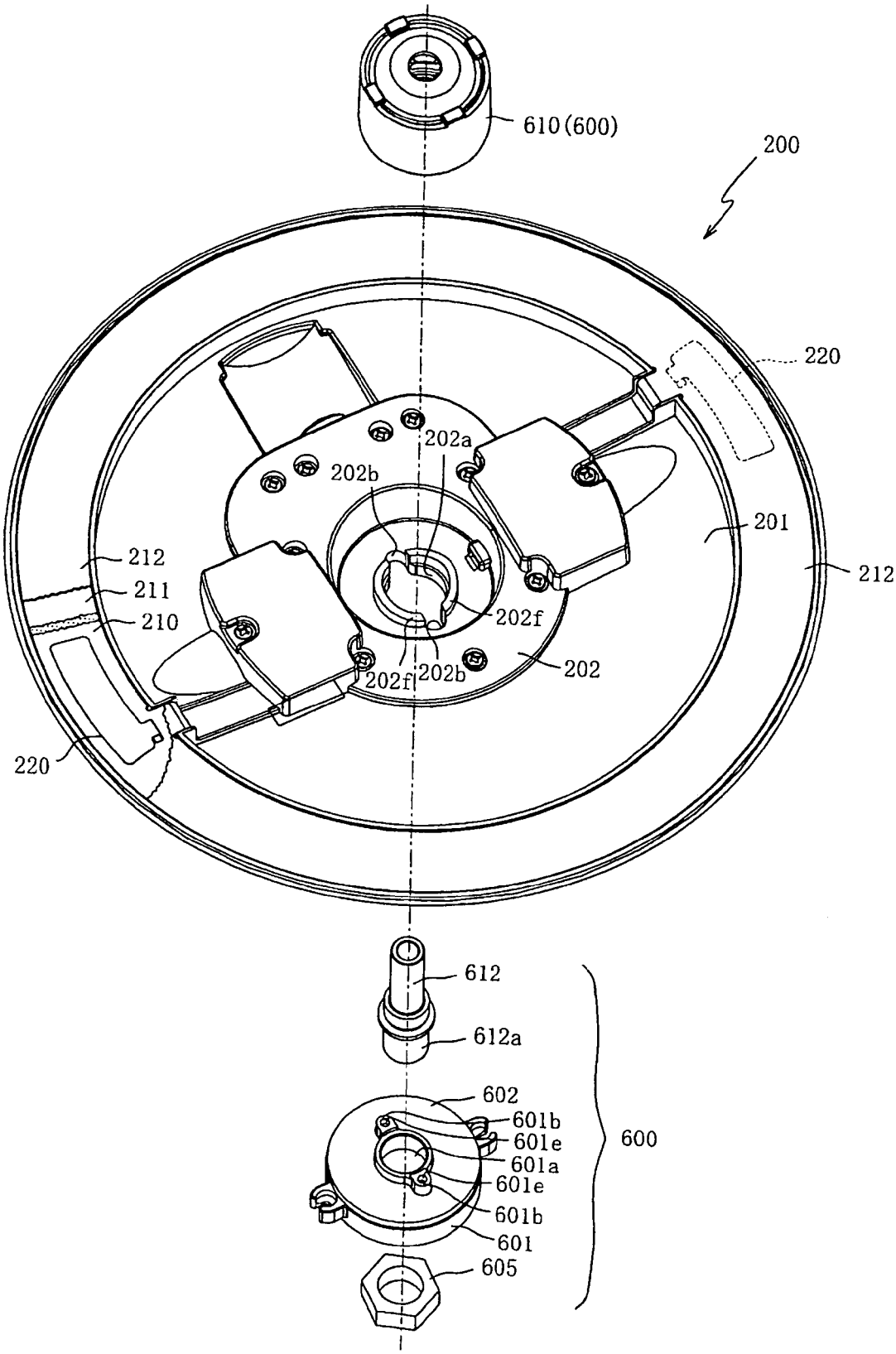
FIG. 7 shows a bottom cymbal pad section and a second fixing element of the embodiment of FIG. 1.

Next, an explanation will be given regarding the structure of the bottom cymbal pad section 200 while referring to FIG. 1 through 3 as well as to FIG. 6 and FIG. 7. FIG. 6 is a front view of the top surface side of the bottom cymbal pad section 200. FIG. 7 is a drawing in which the bottom cymbal pad section 200 is separated from the second fixing element 600. In this preferred embodiment of the invention, a "top surface of the bottom cymbal pad section 200" and a "bottom surface of the bottom cymbal pad section 200" indicate respectively the top surface and the bottom surface when the pad is attached to the stand section 400. These meanings will be used hereinafter.

As shown in FIG. 1, the bottom cymbal pad section 200 comprises a first bottom frame 201 and a second bottom frame 202. The second bottom frame 202 is placed adjacent to the center section of the top surface side of the bottom cymbal pad section 200. There is also a stereo jack 250 for inputting signals from the vibration sensor 110 and the edge sensor 160. Those signals are outputted from the stereo jack 150 located on the top cymbal pad section 100. The signals are transmitted via the plug 151, the cable 152, and a plug 251. An output jack 240 outputs the signals of each of the sensors that have been input from the stereo jack 250 and a close switch 220. The close switch is located on periphery of the bottom cymbal pad section 200. A graphic representation of cable 152 has been omitted from FIG. 2 and FIG. 3 in order to simplify the illustrations.

The first bottom frame 201 comprises hard plastic such as ABS resin or a polycarbonate resin and the like. Similarly to the top cymbal pad section 100, the top surface side and the bottom surface side are roughly circular in shape and the bottom surface side has a raised dish shape in the form of a dome in the area of the center.

An opening section 201*a* is located in the center of the first bottom frame 201. The opening section 201*a* has a roughly circular shape having two groove sections that correspond to two groove sections 202*b* that are part of the second bottom frame 202.

As shown in FIG. 1 and FIG. 5, on the upper surface 201*b* of the periphery section of the first bottom frame 201, there is a metal plate 210. The metal plate 210 is fixed on the bottom surface of the first bottom frame 201 by screws 213. The metal plate 210 can be an iron plate or an aluminum plate having a toroidal concave shape. Although not shown in the drawings, the screws 213 are arranged evenly in a suitable number (for instance, 10) only on the periphery of the metal plate 210 that has been placed in a toroidal shape on the first bottom frame 201.

A cushion material 211 that comprises a base material having elasticity such as rubber, coats the top side of the metal plate 210. In addition, an edge sliding film 212 is layered on the top side of the cushion material 211. Here, the edge sliding film 212 is placed so that the film together with the upper surface 201*b* of the periphery section of the first bottom frame 201 become virtually a single flat surface. In addition, the coated section of the cushion material 211 and the edge sliding film 212 is extended to cover the top of the two wiring holders 201*c* through which the wiring passes. That is done in order to protect the wiring (not shown in the drawing) that extends from the close switch 220 (discussed later) to the output jack 240 that is housed in the second bottom frame 202.

The edge sliding film 212 ensures a smooth sliding contact between the top cymbal pad section 100 and the bottom cymbal pad section 200 when the top cymbal pad section 100 is struck. The edge sliding film 212 comprises a resin that is a material of moderate strength with favorable sliding properties. Examples of such materials are polyester and TEFLON. Thus, when the top cymbal pad section 100 is struck, the edge sliding tube 140 located on the top cymbal pad section 100 can slide smoothly on the edge sliding film 212. As a result, the top cymbal pad section 100 and the bottom cymbal pad section 200 swing smoothly while coming into contact. The sliding mechanism that comprises the edge sliding film 212 and the edge sliding tube 140 will be discussed in further detail later.

Moreover, as shown in FIG. 6 and FIG. 7, two close switches 220 that are film form pressure sensitive sensors, are each placed between the metal plate 210 and the cushion material 211 in the left and right sides of the bottom cymbal pad section 200. In FIG. 7, a portion of the cushion sheet material that covers the close switch 220 and the edge sliding film 212 in the area that includes one of the pair of close switches 220 (the close switch 220 that is located on the left side of the bottom cymbal pad section 200) has been omitted. The close switch 220 is shown exposed. In addition, in the cross-sectional view in FIG. 3, a close switch 220 should be shown in the drawing between the metal plate 210 and the cushion material 221. However, the illustration has been simplified in order to prevent the drawing from becoming complicated.

The close switch 220 is a film form pressure sensitive sensor having a multilayer structure. It is a sensor that detects a closed state of the electronic HiHat cymbal 1. As shown in FIG. 3, when a pedal (not shown in the drawings) that is placed on the bottom of the stand section 400 is stepped on, the top cymbal pad section 100 and the bottom cymbal pad section 200 may come into contact and may be put into a closed state. The close switch 220 detects the pressure created by the edge sliding tube 140 that is placed on the top cymbal pad section 100. The signal that is generated as a result of the detection is transmitted to the output jack 240 via wiring that is not shown in the drawings.

The close switch 220 is pressed by the edge sliding tube 140 of the top cymbal pad section 100. Since the close switch 220 is pressed at the highest point of the metal plate 210, the pressing detection sensitivity is satisfactory.

In addition, since the close switch 220 is pressed through the cushion material 211, which has elasticity, the pressing force from the edge sliding tube 140 is distributed to a proper degree and transmitted to the close switch 220. Therefore, the detection sensitivity of the close switch 220 can be increased.

When the top cymbal pad section 100 is struck, the top cymbal pad section 100 swings. As a result, one or the other of the close switches can be pressed. One close switch 220 is placed on the left side and one close switch 220 is placed on the right side of the bottom cymbal pad section 200. This pair of close switches 220 is used to effectively detect whether or not both sides of the bottom cymbal pad section 200 are pressed at the same time. In other words, even when the striking surface (the front surface) of the top cymbal pad section 100 has been struck in a closed state, since the pressing force by the edge sliding tube 140 is relatively unaffected by the swinging movement, it is possible to reliably detect a closed state.

Figure 8:
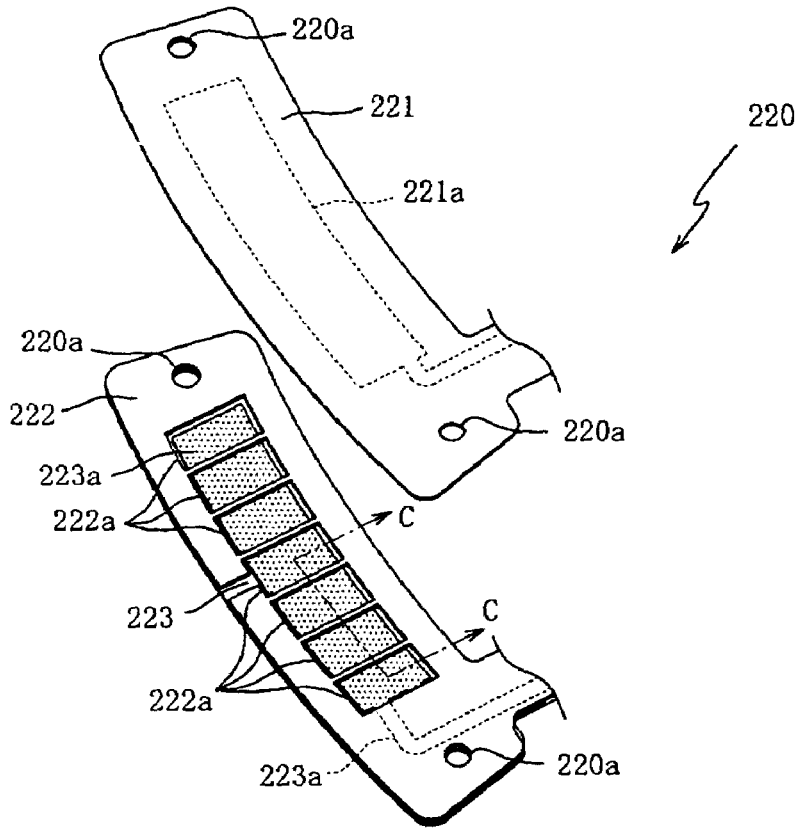
FIG. 8 is a drawing explaining the structure of a close switch.
Figure 8:
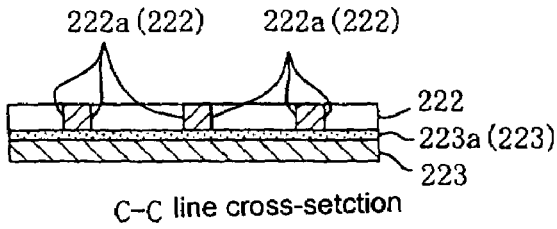

An explanation will be given regarding the close switch 220 while referring to FIG. 8. FIG. 8 is a drawing that explains the structure of the close switch 220. FIG. 8(*a*) is a drawing in which the close switch 220 is explained in more detail, and FIG. 8(*b*) is a drawing of a cross-sectional view of FIG. 8(*a*) along the C-C portion.

The close switch 220 is a layered body comprising three layers—a first base film 221, a spacer film 222, and a second base film 223. The first base film 221 is a layer that is placed on the side adjacent to the cushion sheet material 211. The second base film 223 is a layer that is on the side adjacent to the metal plate 210. The spacer film 222 is layered between the first base film 221 and the second base film 223. The more detailed drawing of FIG. 8(*a*) shows the first base film 221 towards the top of the page. The part of the close switch 220 comprising the second base film 223 and the spacer film that has been laminated on the upper side of the second base film (the first base film 221 side) is shown in the drawing towards the bottom of the page.

The first base film 221 is a thin film that is made from a resin having insulating properties. The first base film 221 has a first conductive pattern 221*a* printed on one side. The first conductive pattern 221*a* in FIG. 8(*a*) shows the region in which the conductive pattern is printed. An explanation of a wiring pattern for the first conductive pattern 221*a* has been omitted since it is not an essential part of the embodiment of the present invention.

The second base film 223 is a thin film that is made from a resin having insulating properties. A second conductive pattern 223*a* is printed on one side of the second base film 223. The second conductive pattern 223*a* in FIG. 8(*a*) shows the region in which the conductive pattern is printed as a shaded region (the portion that is concealed by the spacer film is shown by a dotted line). An explanation of a wiring pattern for the second conductive pattern 223*a* is omitted since it is not an essential part of the present invention.

In the close switch 220, the first conductive pattern 221*a* of the first base film 221 and the second conductive pattern 223*a* of the second base film 223 are placed facing opposite each other. When the first conductive pattern 221*a* and the second conductive pattern 223*a* come into contact, a current is conducted. The current allows for the switch to be detected as being on.

The spacer film 222 is a thin film that is made of a resin having insulating properties. As shown in FIG. 8(*a*), in the close switch 220, a plurality of pass through holes 222*a* that are arranged in a row along the length of the spacer film 222 are placed in an area between, the first conductive pattern 221*a* and the second conductive pattern 223*a*.

The first conductive pattern 221*a* and the second conductive pattern 223*a* can both be exposed by the plurality of pass-through holes 222*a*. However, as shown in FIG. 8(*b*), in a static period, the first conductive pattern 221*a* and the second conductive pattern 223*a* are separated. When the top cymbal pad section 100 and the bottom cymbal pad section 200 are in an open state, the first conductive pattern 221*a* and the second conductive pattern 223*a* are separated and there is no flow of current. On the other hand, as a result of a contact or pressing of the top cymbal pad section 100 on the bottom cymbal pad section 200 when the top cymbal pad section 100 and the bottom cymbal pad section 200 are in a closed state, the first base film 221 is bent. As a result, the first conductive pattern 221*a* and the second conductive pattern 223*a* come into contact and a current is conducted.

In addition, due to the fact that a plurality of pass-through holes 222*a* are placed in the spacer film 222, as shown in FIGS. 8(*a*) and (*b*), a plurality of spacer parts are formed. The spacer parts provide support while separating the first conductive pattern 221*a* and the second conductive pattern 223*a*. Deterioration of the cushion sheet material 211 and resulting erroneous operation of the close switch 220 can occur over time. The spacer parts make it possible to limit the occurrences of contact between the first conductive pattern 221*a* and the second conductive pattern 223*a* that are a result of bending due to the deterioration of the cushion sheet material 211.

The positioning holes 220*a*, which pass through the first base film 221, the spacer film 222, and the second base film 223, are placed on both ends of the close switch 220 along its length. The positioning holes 220*a* are mated with protrusions (not shown in the drawing) used for positioning. The protrusions are placed in specified locations on the first bottom frame 201 and pass through the metal plate 210. They are also arranged in specified locations on the close switch 220. The close switch 220 that has been positioned based on the positioning holes 220*a* is fixed in the metal plate 210 by means of double sided tape, adhesive or the like.

Further explanation will be given regarding the structure of the bottom cymbal pad section 200 while referring to FIG. 1 through 3 as well as FIG. 6 and FIG. 7. The second bottom frame 202 is a frame that comprises an elastic body of a flexible material such as, for example, rubber. The second bottom frame 202, as shown in FIG. 3, has an opening section 202*a* that is formed along the inner peripheral side on the opening section 201*a* of the first bottom frame 201 and a concave section 202*c* that has a bottom surface that is formed along the inside (the surface of the upper side on the page in FIG. 3) of the dome section 201*d* of the first bottom frame 201. In addition, as shown in FIG. 6, the second bottom frame 202 is furnished with a case section 202*d* for housing the two output jacks 240 on the left and right side of the bottom cymbal pad section 200. There is also a case section 202*e* for housing the stereo jack 250. The stereo jack 250 inputs signal from the top cymbal pad section 100 to the bottom cymbal pad section 200. The second bottom frame 202, as shown in FIG. 1 and FIG. 6, is fixed to the first bottom frame 201 by screws 204.

The opening section 202*a*, as described above, has a circular shape that follows along the inner peripheral side of the opening section 201*a* of the first bottom frame 201. As shown in FIG. 6, the opening section 202*a* opens in roughly a circular shape and has two groove sections 202*b* that are located opposite each other along the diameter. A convex section 601*b* of a bottom anchor 601, which is fixed so that rotation on an axis about the hollow shaft 410 of the stand section 400 is not possible, is mated from below to the opening section 202*a*. Moreover, the convex section 611*a* of the displacement sensor 610 is mated to the opening section 202*a* from above. When a protuberant section 611*d* located on a convex section 611*a* of a displacement sensor 610 is inserted into a latching hole 601*e* located on the convex section 601*b* of the bottom anchor 601, the convex section 601*b* and the convex section 611*a* are linked on the inner peripheral side of the opening section 202*a*.

Since the convex section 601*b* and the convex section 611*a* both, as will be discussed later, have shapes that are nearly identical to that of the opening section 202*a*, the bottom cymbal pad section 200 is fixed so that rotation is not possible with respect to the displacement sensor 610 and to the bottom anchor 601. Furthermore, the bottom anchor 601 is fixed so that rotation about the axis of the stand section 400 is not possible. Therefore, due to the corresponding shapes of the opening section 202*a*, the convex section 601*b*, and the convex section 611*a*, rotation by the bottom cymbal pad section 200 about the axis of the stand section 400 is not possible even when swinging has been produced together with the swinging of the top cymbal pad section 100. Accordingly, since it is possible to place the various types of sensors on the bottom cymbal pad section 200 in specific locations, the placement of the pair of close switches 220 can be predetermined. For instance, the locations can be limited to the left and right side of the bottom cymbal pad section 200. Those locations happen to be the most desirable locations in this case.

As shown in FIG. 7, two protuberant sections 202*f* are placed on the periphery of an opening section 202*a* separating groove sections 202*b*. The groove sections 202*b* are placed in a direction of the diameter that corresponds to the front to back direction of the bottom cymbal pad section 200. The protuberant sections 202*f* both have a dome like shape with an apex roughly in the center. In other words, the protuberant sections 202*f* are shaped so that the parts that correspond to the left to right direction of the bottom cymbal pad section 200 become high. Thus, as will be discussed later, it is possible to fix the bottom cymbal pad section 200 so that front to back swinging by the second fixing element is possible.

In addition, as shown in FIG. 3, the two output jacks 240 are placed so that their respective opening sections 240*a* face the left to right direction of the bottom cymbal pad section 200. They are exposed to the outside of the first bottom frame 201. Since the opening sections 240*a* of the two output jacks 240 face toward the left to right direction, it is not likely that the wiring cords that are connected to the output jacks 240*a* will become entangled and the dropping out of the plugs of the wiring cords from the output jacks 240*a* can be prevented. In addition, since the bottom cymbal pad section 200 is limited to swinging in the front to back direction, it is not likely that the wiring cords that have been connected to the output jacks 240, the opening sections 240*a* of which face in the left to right direction, will be affected by the swinging. Hence, it is not likely that the plugs of the wiring cords will fall out of the output jacks 240.

Figure 9:
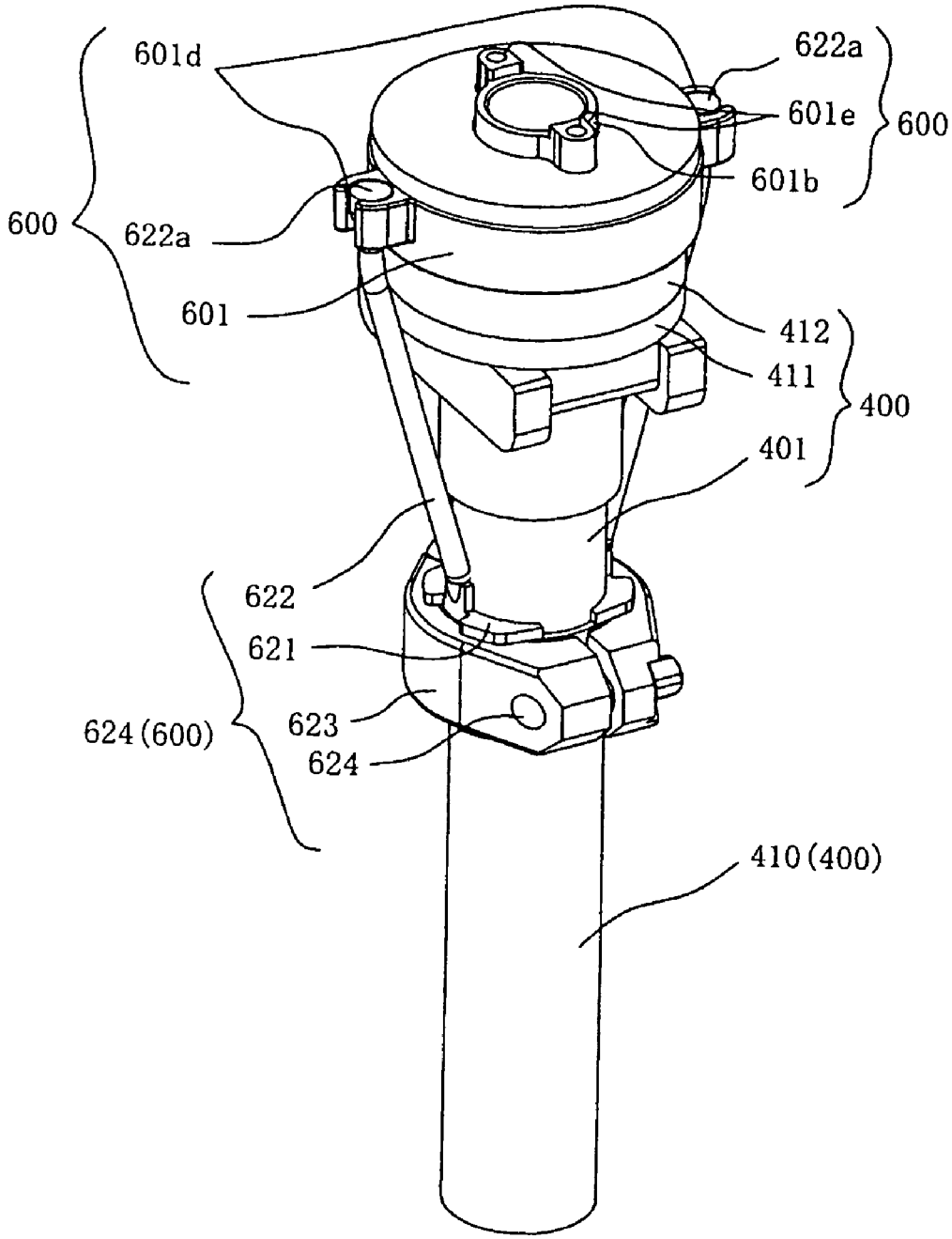
FIG. 9 is a drawing explaining the structure of a second fixing element of the embodiment of FIG. 1.
Figure 10:
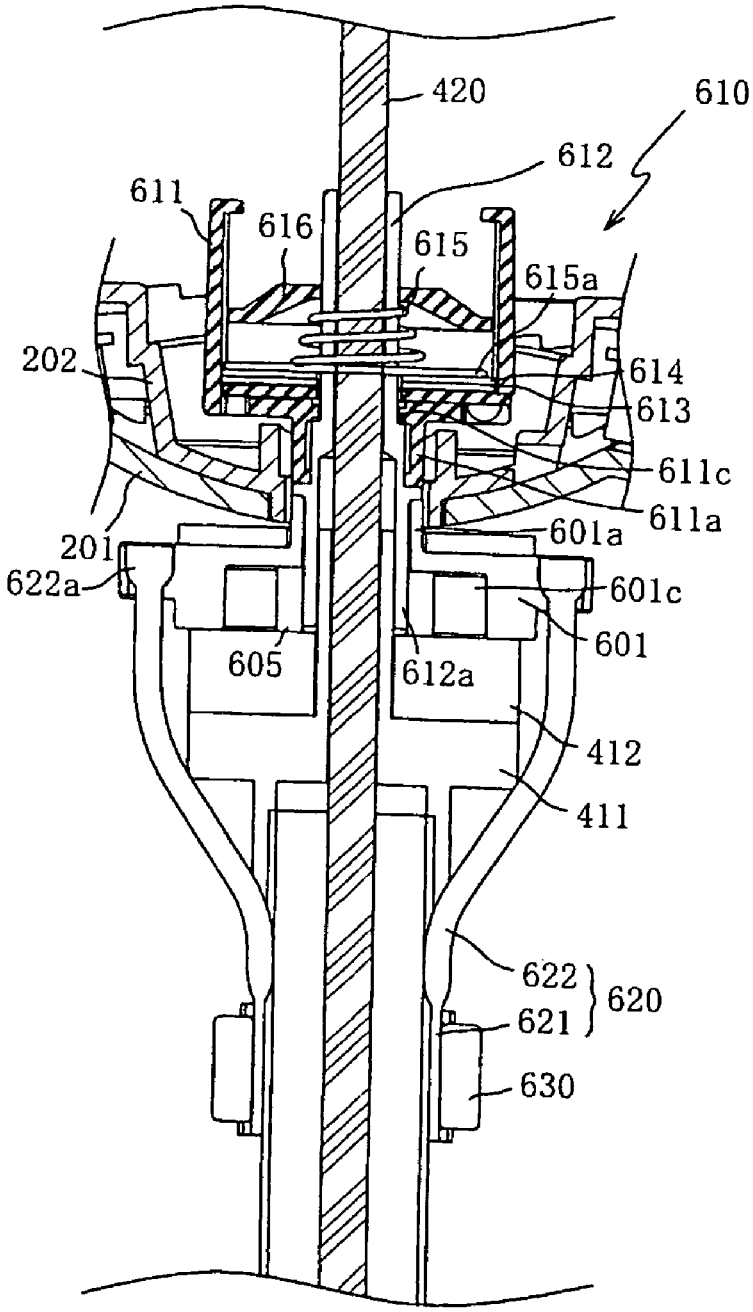
FIG. 10 is a more detailed cross-sectional view of the area around the second fixing element shown in FIG. 3.

Next, an explanation will be given regarding a second fixing element 600 with which the bottom cymbal pad section 200 and the stand section 400 are fixed while referring to FIG. 7, FIG. 9 and FIG. 10. FIG. 9 is a drawing explaining the structure of the second fixing element 600 of the preferred embodiment. FIG. 10 is a partially expanded cross-sectional view of the area around the second fixing element 600 illustrated in the cross-sectional view of the electronic HiHat cymbal in FIG. 3.

The second fixing element, as shown in FIG. 7, comprises a bottom anchor 601 that supports the first bottom frame 201 from below, a displacement sensor 610 in which the first bottom frame 201 is pressed from above with respect to the bottom anchor 601, and a clamp section 620 with which the bottom anchor 601 is fixed to the stand section 400.

The bottom anchor 601 is a metal component such as an aluminum cast and the like. It has an opening section 601*a* that is formed in the center, two convex sections 601*b* that are mated to the groove sections 202*b* of the second bottom frame 202, latching holes 601*e* that are formed in the convex sections 601*b*, concave sections 601*c* that are formed on the sides opposite the surfaces on which the convex sections 601*b* are formed, and hook sections 601*d* that have been formed on the side surfaces. An elastic body sheet, such as a rubber sheet and the like, is placed on the upper portion of the bottom anchor 601 as a cushion material 602 for the bottom cymbal pad section 200.

The displacement sensor 610 is a sensor for detecting the amount of displacement of the top cymbal pad section 100. The structure of this sensor will be discussed later. The lower side (the bottom surface) of the outer periphery of the case section 611 of the displacement sensor 610 is nearly flat. A convex section 611*a* is placed on this nearly flat surface. The convex section 611*a* has a shape that matches the opening section 202*a* that has the groove sections 202*b*. The convex section 611*a* also has a protuberant section 611*d* (refer to FIG. 1) for insertion into the latching hole 601*e* of the bottom anchor 601. In addition, an opening 611*c* is placed on the convex section 611*a*. The opening 61*c* is a part of the pass-through hole that passes vertically through the displacement sensor 610.

Moreover, as shown in FIG. 10, the displacement sensor 610 has a sleeve 612 that is placed so that the sleeve passes through the center of the displacement sensor 610 vertically. A threaded section 612*a* protrudes on the lower side of the displacement sensor 610.

As shown in FIG. 7, the bottom cymbal pad section 200 is placed between the bottom anchor 601 and the displacement sensor 610. As previously discussed, the shapes of the convex section 601*b* of the bottom anchor 601 and the convex section 611*a* of the displacement sensor 610 are matched with the shape of the opening section 202*a*, which has the groove sections 202*b*. The protuberant section 611*d* of the displacement sensor 610 is also mated with the latching hole 601*e* on the bottom anchor 601 side. In addition, a nut 605 is screwed on the inside of the concave section 601*c* to the threaded section 612*a* of the bottom anchor 601 that passes through the bottom cymbal pad section 200. Thus, the bottom cymbal pad section 200 is fixed by the second fixing element 600.

In the second fixing element 600, the shapes of the convex section 601*b* of the bottom anchor 601 and the convex section 611*a* of the displacement sensor 610 are matched to the shape of the opening section 202*a* that has two groove sections 202*b*. Thus, the bottom cymbal pad section 200 is fixed so that rotation about the second fixing element 600 is not possible.

As previously explained, the two protuberant sections 202*f* that are placed on the second bottom frame 202 of the bottom cymbal pad section 200 are formed so that the portions that correspond to the left or right direction of the bottom cymbal pad section 200 are high and incline downward toward the two edges of the protuberant sections 202*f*. Therefore, while contacting the outer peripheral bottom surface of the case section 611 of the displacement sensor 610, the bottom cymbal pad section 200 is limited to swinging in the front to back direction of the bottom cymbal pad section 200. Accordingly, the second fixing element 600 fixes the bottom cymbal pad section 200 to the stand section 400 so that swinging is only possible from front to back.

Since the swinging direction of the bottom cymbal pad section 200 is restricted to the front to back direction, the pair of close switches 220 that are placed in the left to right direction of the bottom cymbal pad section 200 are not likely to be affected by swinging centered on the front to back direction due to striking. Thus, it is possible to detect a closed state with a high degree of precision.

The displacement sensor 610 functions not only as a sensor but also, because of the case section 611, as a part of the second fixing element 600. Therefore, it is possible to reduce the number of components of the electronic HiHat cymbal 1. Hence, the manufacturing costs can be lowered.

As shown in FIG. 9, when the bottom cymbal pad section 200 is placed between the bottom anchor 601 and the displacement sensor 610, the bottom anchor 601 is fixed to the stand section 400 by a clamp section 620. A clamp section 620 comprises a clamp 621 and arms 622 of an elastic body such as elastomer and the like, a clamp holder 623, and a screw 624 with which the free ends of the clamp holder 623 are fastened.

The clamp section 620 holds the hollow shaft 410 with the clamp 621. The clamp is held by a clamp holder 623 from the outside. By fastening both of the free ends of the clamp holder 623 with the screw 624, the clamp section 620 is fixed to the hollow shaft 410 so that rotation is not possible.

On the other hand, the bottom anchor 601, on which the bottom cymbal pad section 200 is placed, is located on the lower felt washer 412. The washer 412 is made of felt. In a mating sections 622*a*, the arms 622 are mated with hook sections 601*d* that are placed on the sides of the bottom anchor 601. The mating section 622*a* has a diameter that is slightly larger than the diameter of the main body section of the clamp section 620 and the inner diameter of the hook section 601*d*. The mating section 622*a*, which is an elastic body, is deformed by pressing and is thus mated with the hook section 601*d*. As a result, the mating section 622*a* is not likely to fall out from the hook section 601*d*.

In addition, since the clamp section 620 comprises, as described above, an elastic body, the clamp section 620 is bendable. Thus, because the arm 622 bends according to the shape of the felt holding section 411 that holds the lower felt washer 412, attachment of felt holding sections of various shapes is possible. Accordingly, the bottom cymbal pad section 200 can be attached to a commercial stand section 400.

Next, the structure of the sensor portion of the displacement sensor 610 is explained. The displacement sensor 610, as shown in FIG. 10, comprises a case section 611, which is a hollow compartment that could have a cylindrical shape with an opening on the upper surface. The displacement sensor 610 also comprises a circular sensor sheet 613 that is housed in the bottom section on the inside of the case section 611, a hard base plate 614 that is placed below the sensor sheet 613 and has roughly the same shape as the sensor sheet 613, a conical coil spring 615 that is placed above the sensor sheet 613 and spreads in the direction from the top cymbal pad section 100 toward the bottom cymbal pad section 200, and a cover section 616 that has a convex shape facing upward and is in contact with the top of the coil spring 615.

In addition, an opening section 611*c* is placed in the center of the case section 611. The opening section 611*c* is a part of the pass-through hole that passes through from the top to the bottom of the displacement sensor. Although it is not shown in the drawing, opening sections that are also portions of the pass-through hole are placed in the centers of the sensor sheet 613, the hard base plate 614, and the cover section 616. A sleeve 612, through which the extension rod 420 is inserted, is put through each of the opening sections including the opening section 611*c* and the center of the coil spring 615.

Since the extension rod 420 is inserted through the sleeve 612 that passes through the inside of the displacement sensor 610, any bending of the extension rod 420 is not transmitted directly to the displacement sensor 610. The utilized structure eliminates any impact that bending of the extension rod 420 might have on the detection of the amount of displacement of the top cymbal pad section 100 by the displacement sensor. Thus, highly precise detection of the amount of displacement of the top cymbal pad section 100 is possible.

When the pedal, which is not shown in the drawings, is stepped on, the extension rod 420 drops down, and the space between the top cymbal pad section 100 and the bottom cymbal pad section 200 changes from an open state (the state illustrated in FIG. 1) to a closed state (the state illustrated in FIG. 2) in response to the amount of pressure applied on the pedal. Since the top cymbal pad section 100 is fixed to the extension rod 420 by the first fixing element 500, when the extension rod 420 drops down due to the stepping on the pedal, the rotation stopping member 501 also drops down together with the extension rod. When the rotation stopping member 501 drops down, the cover section 616, which is below the rotation stopping member 501, is pressed down. As a result, the coil spring 615 is deformed in the vertical direction by the compression force and is compressed against the sensor sheet 613 and the hard base plate 614.

The deformation resulting from the compression in the vertical direction of the coil spring 615 is detected electrically using the sensor sheet 613. Using wiring that is not shown in the drawings, the output jack 240 outputs to an external processing system the amount of vertical displacement of the extension rod 420 due to the stepping on the pedal. In other words, the amount of displacement of the top cymbal pad section 100 due to the stepping on the pedal is detected.

Figure 11:
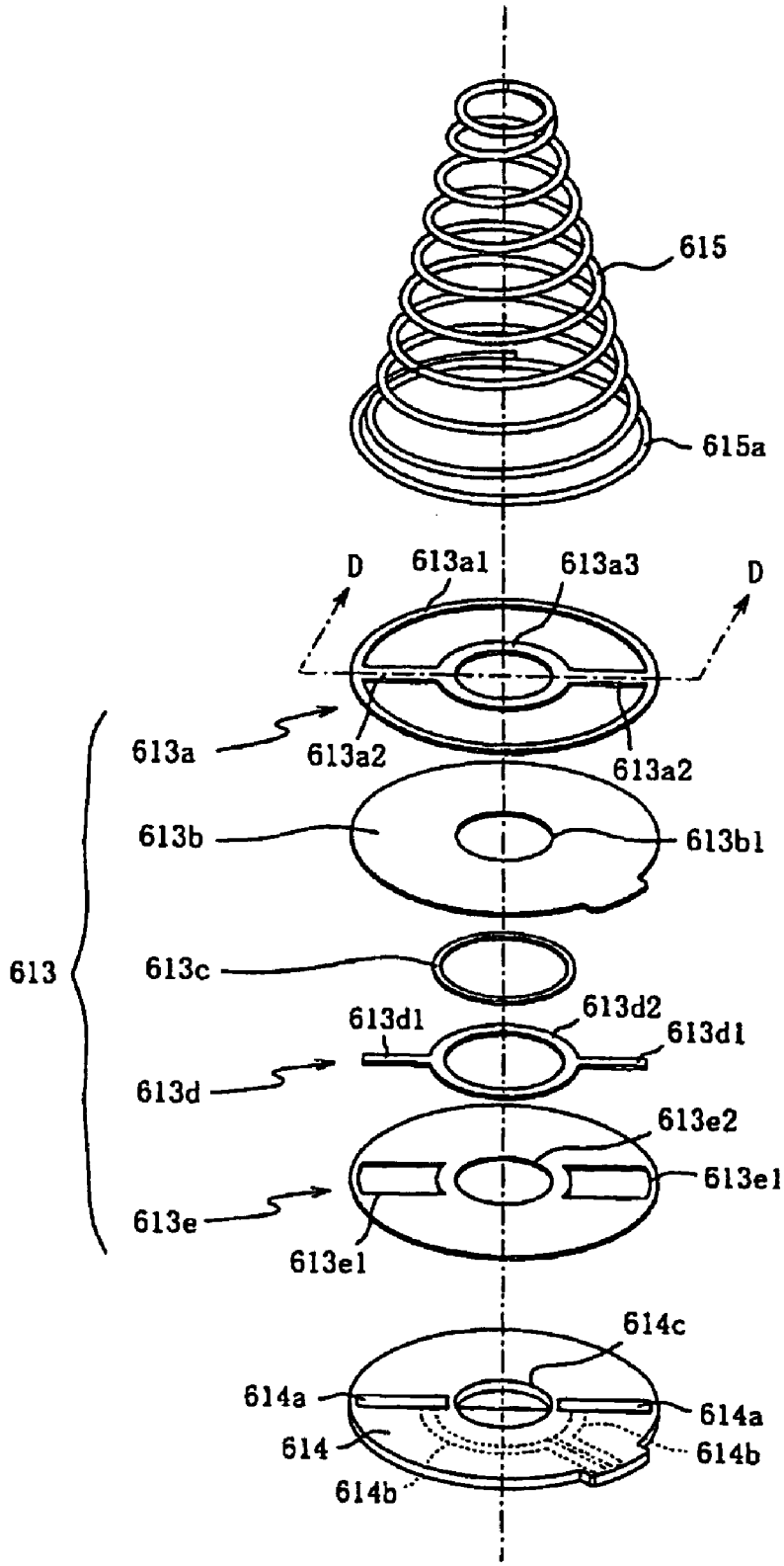
FIG. 11 shows an assembly configuration of a sensor portion of a displacement sensor through which an extension rod is inserted.

An explanation will be given regarding the sensor portion of the displacement sensor 610 while referring to FIG. 11. FIG. 11 is a drawing in which the structure of the sensor portion of the displacement sensor 610 along the direction that the extension rod 420 is inserted through is explained. "The sensor portion of the displacement sensor 610" means the portion that comprises the coil spring 615, the sensor sheet 613, and the hard base plate 614.

The sensor sheet 613 is a layered body such as the one shown in FIG. 11. The comprising layers in order from the side adjacent to the coil spring 615 are a pressing film 613*a*, a base film 613*b*, a printed conductive section 613*c* that is printed on the base film 613*b*, a printed carbon section 613*d* that is printed on the base film 613*b*, and a spacer film 613*e*.

The pressing film 613*a* is a thin film that comprises a plastic film or the like. It could be polyester and the like and could have a roughly toroidal outer peripheral section 613*a*1 that has an outside diameter roughly identical to that of a wider section 615*a* of the coil spring 615 and a width on which it is possible to place the wider section 615*a*. It also comprises two long thin pressing sections 613*a*2 that cross in the direction of the diameter, and a roughly toroidal inner peripheral section 613*a*3 that has an inner diameter with which it is possible to pass through the sleeve 612.

The base film 613*b* is a thin film made of a resin that has insulating properties. The toroidal printed conductive section 613*c* is printed on the surface that is on the side opposite the surface that faces the pressing film 613*a*. The printed carbon section 613*d* is printed so that it covers the printed conductive section 613*c*. The printed carbon section 613*d* has a toroidal ring section 613*d*2 and two long and thin resistance sections 613*d*1 that protrude toward the outside in a direction of the diameter of the ring section 613*d*2. Resistance sections 613*d*1 are placed so that they are subject to pressing by the pressing section 613*a*2 on the sensor sheet 613.

The spacer film 613*e* is a thin film that has insulating properties. It has a pass-through hole 613*e*2 that has an inside diameter which allows for the sleeve 612 to pass through. There are also pass-through holes 613*e*1 which correspond to the resistance sections 613*d*1 exposed on the sensor sheet 613. In addition, the width of the remainder of the outer peripheral portion of the spacer film 613*e* resulting from the formation of the pass-through hole 613*e*1 is a width on which it is possible to place the wider section 615*a*.

The hard base plate 614 is a thin base plate that comprises a glass substrate epoxy laminated plate or the like and comprises a pass-through hole 614*c* through which it is possible to insert the sleeve 612. The hard base plate 614 also comprises two long thin conductive patterns 614*a* that are placed on the surface of the side that faces the sensor sheet 613 in a location in which contact with the resistance section 613*d*1 is possible. The base plate 614 also comprises a drawing out pattern 614*b* that is placed on the surface of the side that faces the sensor sheet 613 and is in contact with the conductive pattern 614*a* via a through hole that is not shown in the drawing. The conductive pattern 614*a* and the drawing out pattern 614*b* are both patterns that are conductive. Thus, for instance, they could be formed from copper foil.

In the sensor portion of the displacement sensor 610, the resistance section 613*d*1, and the conductive pattern 614*a* are exposed to each other in a separated state by the pass-through hole 613*e*2 of the spacer film 613*e*. Because of this, in a static state, the resistance section 613*d*1 and the conductive pattern 614*a* do not come into contact and no current is conducted.

On the other hand, when the pedal that is not shown in the drawing is stepped on causing the coil spring 615 to press from the top to the wider section 615*a* due to the dropping down of the rotation stopping member 501, the coil spring 615 is compressed. As a result, the wire material of the coil spring 615 (wire material 615*b* that will be discussed later) presses on the pressing section 613*a*2 of the pressing film 613*a*. The pressure is transmitted to the resistance section 613*d*1. The resistance section 613*d*1 comes into contact with the conductive pattern 614*a* of the hard base plate 614 and a current is conducted via the drawing out pattern 614*b*.

Figure 12:
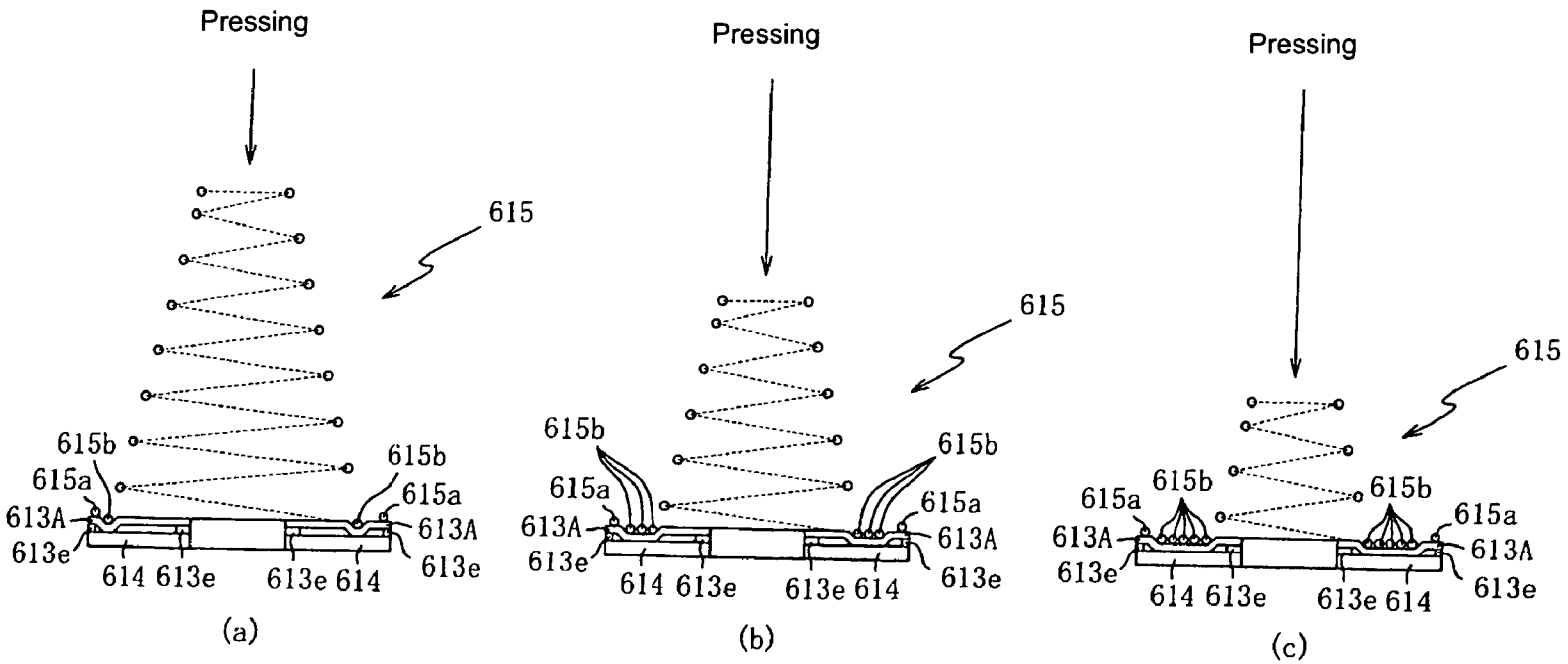
FIG. 12 is a drawing schematically explaining the detection of the amount of displacement of the top cymbal pad section by a displacement sensor.

Next, an explanation is given regarding the essentials of detecting the amount of displacement of the top cymbal pad section 100 by the sensor portion of the displacement sensor 610. FIG. 12 is a drawing that schematically illustrates the detection of the amount of displacement of the top cymbal pad section 100 by using the displacement sensor 610. FIG. 12(*a*), FIG. 12(*b*), and FIG. 12(*c*) illustrate an increasingly bigger coil spring 615 displacement that accompanies the dropping down of the top cymbal pad section 100. FIG. 12 illustrates the sensor portion of the displacement sensor 610.

A structural assembly of the displacement sensor 610 is shown on FIG. 11. FIG. 12 is a cross-sectional view of the sensor components cut at a location that corresponds to the D-D line on the pressing film 613*a* as shown in FIG. 11. In addition, in order to simplify FIG. 12, the layers other than the spacer film 613*e* of the sensor sheet 613 are not illustrated individually. The pressing film 613*a*, the base film 613*b*, as well as the printed conductive section 613*c* and the printed carbon section 613*d* that are printed on the base film 613*b*, have been combined and are shown in the drawing as a sensor layer 613A.

When the coil spring 615 is not pressed, the wire material of the wider section 615*a* of the coil spring 615 is only placed on the outer peripheral portion of the spacer film 613*e*. Thus, the resistance section 613*d*1 and the conductive pattern 614*a* of the hard base plate 614 that are contained in the sensor layer 613A are not in contact and no current is conducted.

As shown in FIG. 12(*a*), when the coil spring 615 is pressed slightly due to the dropping down of the top cymbal pad section 100, the coil spring 615 is compressed and as a result, it changes its shape. When the wire material 615*b* other than the wider section 615*a* of the coil spring 615 presses on the sensor layer 613A, the pressure is transmitted to the pressing section 613*a*2 of the pressing film 613*a* and the resistance section 613*d*1. As a result, the resistance section 613*d*1 and the conductive pattern 614*a* come into contact and a current is conducted.

FIG. 12(*b*) shows the state in which the top cymbal pad section 100 drops further downward than in the state shown in FIG. 12(*a*). The coil spring 615 is further compressed and its shape is further changed. The coil spring 615 presses the sensor layer 613A with more of the wire material 615*b* than in FIG. 12(*a*). As a result, the contact position between the resistance section 613*d*1, which is the printed carbon, and the conductive pattern 614*a* changes. Therefore, the electrical resistance value between the contact positions is lower than in the case illustrated in FIG. 12(*a*).

FIG. 12(*c*) depicts a case in which the top cymbal pad section 100 has dropped further downward than in the state shown in FIG. 12(*b*). The coil spring 615 is further compressed and its shape is further changed. It presses the sensor layer 613A with more of the wire material 615*b* than in FIG. 12(*b*). As a result, the distances of the contact positions between the resistance section 613*d*1, which is the printed carbon, and the conductive pattern 614*a* are less than in the case of FIG. 12(*b*). Therefore, the electrical resistance value between the contact positions is also lower than in the case of FIG. 12(*b*).

In other words, as the contact positions between the resistance section 613*d*1, which is the printed carbon, and the conductive pattern 614*a* change together with the dropping down of the top cymbal pad section 100, the distances of the contact positions also change. Accordingly, by detecting the electrical resistance value between the contact positions, it is possible to detect the amount of displacement up and down of the top cymbal pad section 100.

Since the pressing section 613*a*2, which transmits the compression and change in the shape of the coil spring 615 due to the pressure applied to the resistance section 613*d*1 is long and thin, it is possible to transmit the amount of pressure that is applied to the coil spring 615 in a focused manner to the resistance section 613*d*1. Therefore, the change in the electrical resistance value that accompanies the change in the amount of pressure that is applied to the coil spring 615 can be detected with a high degree of precision.

Figure 13:
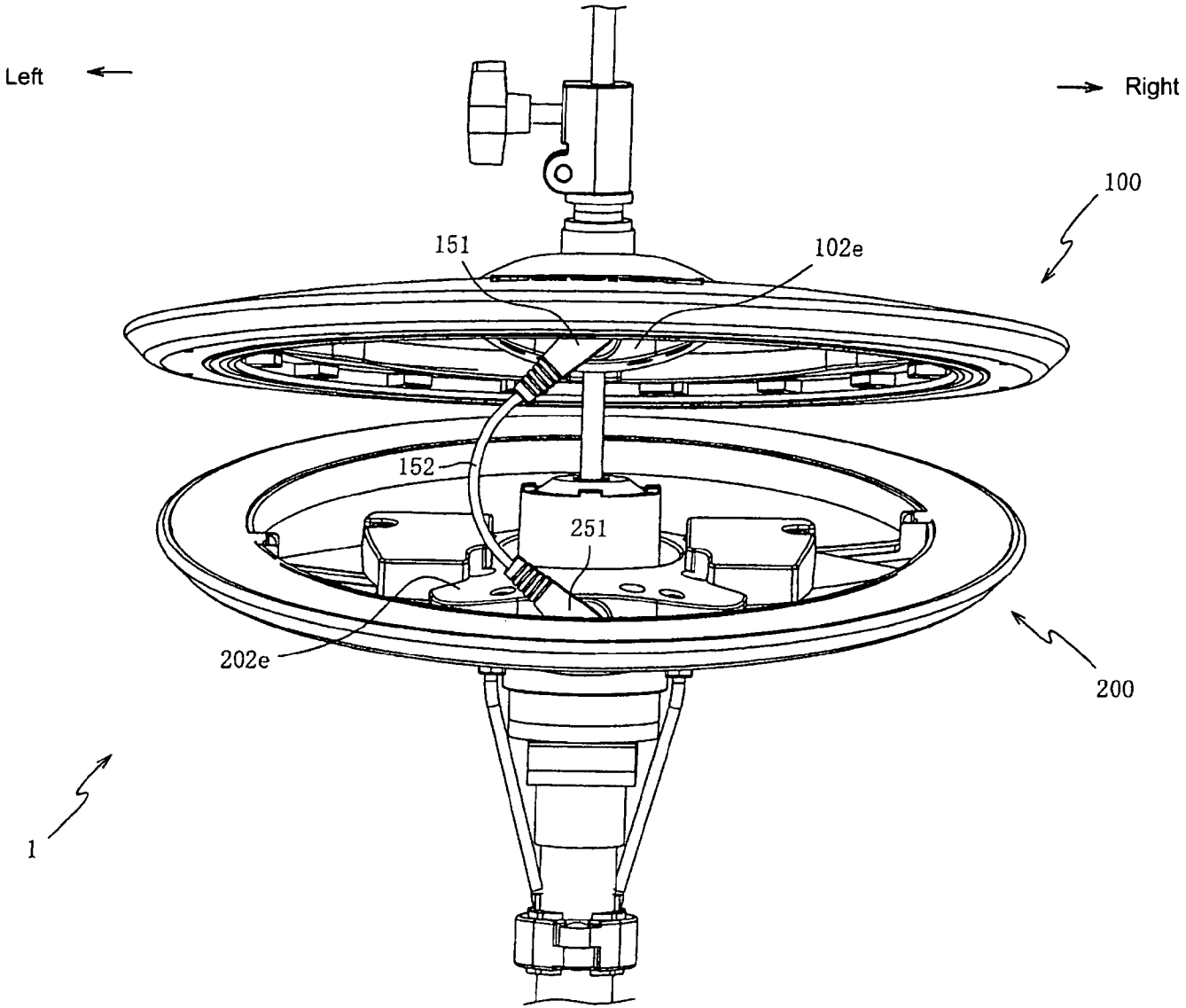
FIG. 13 is a rear-view drawing of an electronic HiHat cymbal of the embodiment of FIG. 1.

Next, an explanation will be given of a case when the top cymbal pad section 100 and the bottom cymbal pad section 200 of the electronic HiHat cymbal 1 of the preferred embodiment are connected. FIG. 13 is a drawing of the electronic HiHat cymbal 1 of the preferred embodiment of the present invention viewed from the rear. A "L" shaped plug 151, which is an end of a cable 152 that is bendable, is inserted and fit into an opening section (not shown in the drawing) of the stereo jack 150 that is placed in the rear side of the case section 102*e* of the top cymbal pad section 100. On the other hand, the "L" shaped plug 251 that is placed on the other end of the cable 152 is inserted and fit into an opening section (not shown in the drawing) of the stereo jack 250 that is placed on the rear side of the case section 202*e* of the bottom cymbal pad section 200.

As shown in FIG. 13, since the opening sections of the stereo jack 150 and the stereo jack 250 both face the rear side, the cable 152 can be made as short as possible and the wiring can be done in a small space. It is possible to design for a reduction in space for the closed state of the electronic HiHat cymbal 1 in those cases where the opening sections of the stereo jack 150 and the stereo jack 250 are both on the rear side. On the other hand, it is also possible to place the opening sections of the stereo jack 150 and the stereo jack 250 both on the right side or both on the left side of the electronic HiHat cymbal 1. In this case, since the swinging movements of both the top cymbal pad section 100 and the bottom cymbal pad section 200 are limited to the front to back direction, it is not likely that the plug 151 and the plug 251 will fall out of place.

In addition, since the plug 151 and the plug 252 are both "L" shaped plugs, even in those cases where the cable is repeatedly stretched or bent, the portions of the plug 151 and the plug 252 that are inserted and fit into the opening sections of the stereo jack 150 and the stereo jack 250 respectively are free to rotate about the long axis. Therefore, it is possible to prevent the falling out of said plugs 151 and 252 from the stereo jack 150 and the stereo jack 250 respectively when the plug 151 and the plug 252 are pulled on. Furthermore, the load placed on the plug 151 and the plug 252 can be reduced and damage to the plugs can be prevented.

Figure 14:
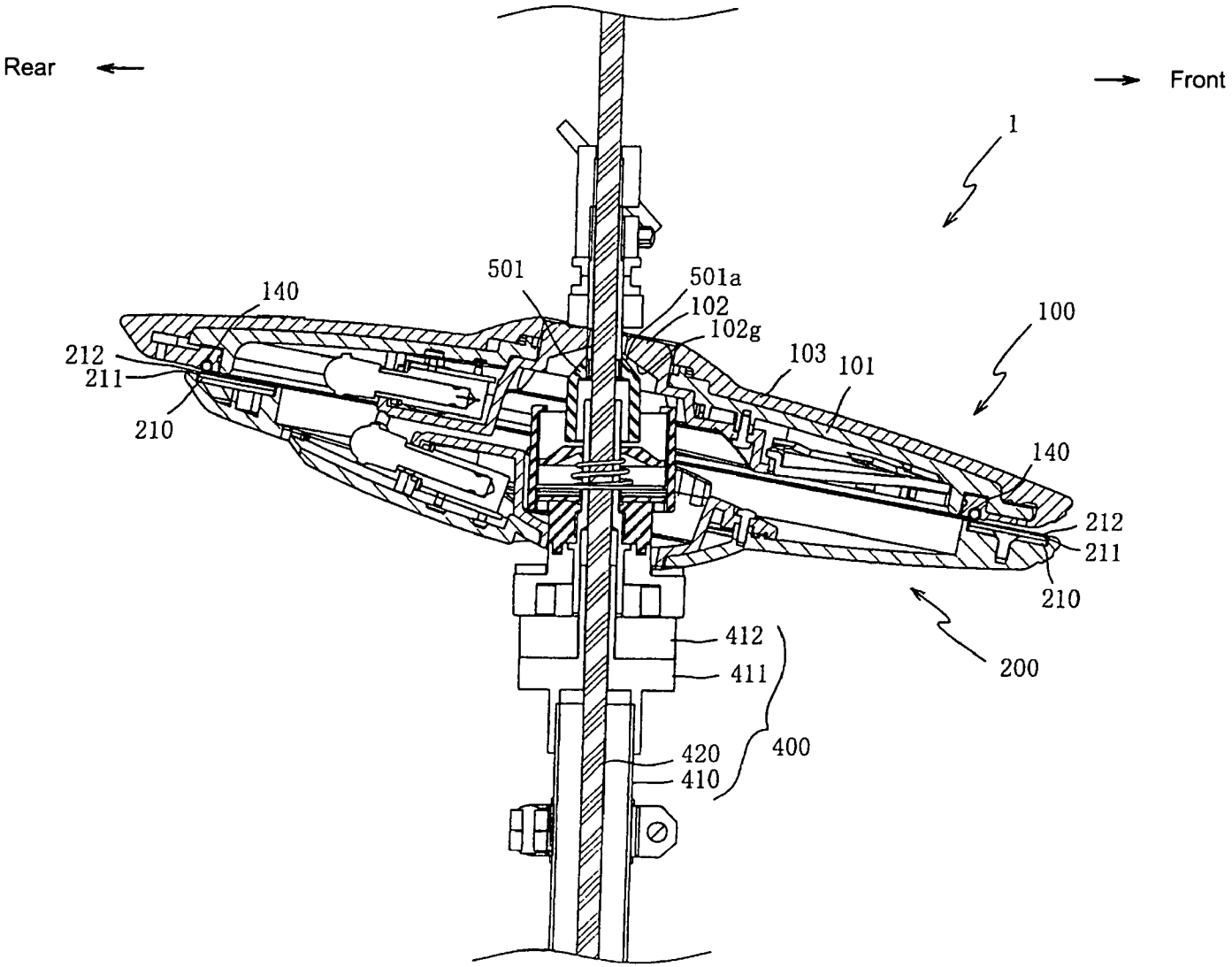
FIG. 14 is a front to back cross-sectional view of a closed electronic HiHat cymbal that is inclined as a result of being struck.

Next, an explanation will be given regarding the sliding mechanism of the top cymbal pad section 100 and the bottom cymbal pad section 200 of the electronic HiHat cymbal 1 of the present invention while referring to FIG. 14. FIG. 14 is a cross-sectional view of the same cross-section as FIG. 1 where the electronic HiHat cymbal 1 of the preferred embodiment of the present invention is inclined forward after the cymbal has been struck in a closed state. In order to simplify the explanation, the explanation is being given only for a closed state of the electronic HiHat cymbal 1.

As has been explained before, the top cymbal pad section 100 is fixed by the first fixing element 500 so that swinging in the front to back direction is possible. On the other hand, the bottom cymbal pad section 200 is fixed by the second fixing element so that swinging in the front to back direction is possible. Because of this, when the top side of the top cymbal pad section 100 is struck, the top cymbal pad section 100 swings in the front to back direction. The swinging of the top cymbal pad section 100 is transmitted to the bottom cymbal pad section 200. Then the bottom cymbal pad section 200 also begins to swing in the front to back direction.

The edge sliding tube 140 and the edge sliding film 212 both comprise a material having sliding properties. Since the portions of the top cymbal pad section 100 and the bottom cymbal pad section 200 that are in contact with each other respectively utilize the edge sliding tube 140 and the edge sliding film 212, the edge sliding tube 140 slides smoothly on the edge sliding film 212. As a result, the swinging of the top cymbal pad section 100 and the bottom cymbal pad section 200 is carried out smoothly. Thus, the striking sensation is a natural sensation that is analogous to that of an acoustic HiHat cymbal.

In addition, as shown in FIG. 14, in a state where the top cymbal pad section 100 and the bottom cymbal pad section 200 are inclined forward, the edge sliding tube 140 reaches the edge section on the left side of the page on the edge sliding film 212. Although it is not shown in the drawing, in a state where the top cymbal pad section 100 and the bottom cymbal pad section 200 are inclined toward the rear, the edge sliding tube 140 reaches the edge section on the right side of the page on the edge sliding film 212. In other words, when the swinging motion is in the front to back direction, the edge sliding tube 140 is shifted from edge to edge on the edge sliding film 212. Therefore, because the edge sliding film has a length of a proper range, it is possible to adequately cover a region in which gliding contact with the edge sliding tube 140 is possible at all times during swinging.

As described above, since the top cymbal pad section 100 and the bottom cymbal pad section 200 are both fixed so that they can swing together, it is possible to obtain a performance sensation that is closer to that of an acoustic HiHat cymbal.

In addition, since the edge sliding tube 140 and the edge sliding film 212 are placed on the top cymbal pad section 100 and the bottom cymbal pad section 200 respectively, the swinging movement due to the striking of the top cymbal pad section 100 while the top cymbal pad section 100 and the bottom cymbal pad section 200 are in contact has the same smoothness as that of an acoustic HiHat cymbal. Therefore, it is possible to obtain a striking sensation that is a natural sensation analogous to that of an acoustic HiHat cymbal.

Furthermore, neither the top cymbal pad section 100, nor the bottom cymbal pad section 200 will rotate about the axis of the stand section 400 and the extension rod 420. In addition, since the swinging direction is limited to the front to back direction, the placement of the sensors and the cables is convenient.

An explanation was given above of the present invention based on a preferred embodiment. However, the present invention is in no way limited to the preferred embodiment described above. Various modifications and changes that do not deviate from and are within the scope of the essentials of the present invention are possible.

For example, in the preferred embodiment described above, the edge sliding tube 140 is such that a ring-shaped tube is placed on the periphery of the top cymbal pad section 100. However, a configuration in which a protuberant sliding member is used is also viable.

What is claimed is:

1. An electronic percussion instrument, comprising:

a first pad having a striking surface comprising an elastic body;

first fixing means with which the first pad is fixed such that the pad is free to swing on a rod that moves up and down in accordance with a specified operation;

a second pad that faces the first pad;

second fixing means with which the second pad is fixed such that the pad is free to swing on the rod and in a position in which it is possible to transfer the swinging motion of the first pad to the second pad; and a first sensor with which a striking of the first pad is detected, wherein a sliding member that promotes the mutual sliding of the pads is furnished in an area in which the first pad and the second pad are mutually in contact;

wherein the first pad and the second pad have a roughly circular dish shape;

wherein a first sliding member protrudes from an attachment surface of either the first pad or the second pad, the first sliding member having a roughly arc shaped portion that protrudes from the attachment surface in the cross-section in the direction of the diameter of said first or second pad;

wherein a flat shaped second sliding member is disposed on the outer periphery of the other pad from the pad that has the first sliding member, the second sliding member located in a position that faces the first sliding member; and wherein the first sliding member is a tube shaped member that has a roughly toroidal shape.

2. The electronic percussion instrument of claim 1, wherein the second sliding member is one that is formed such that the width of the second sliding member in the direction in which the first sliding member is in contact with and slides on the second sliding member, is at least the distance that the first sliding member slides based on the striking of the first pad.

3. The electronic percussion instrument of claim 1, further comprising:

a second sensor that detects if the roughly arc shaped portion of the first sliding member has made contact with the second sliding member or if the second sliding member has been pressed.

4. An electronic percussion instrument, comprising:

a first pad having a striking surface comprising an elastic body;

first fixing means with which the first pad is fixed such that the pad is free to swing on a rod that moves up and down in accordance with a specified operation;

a second pad that faces the first pad;

second fixing means with which the second pad is fixed such that the pad is free to swing on the rod and in a position in which it is possible to transfer the swinging motion of the first pad to the second pad; and a first sensor with which a striking of the first pad is detected, wherein a sliding member that promotes the mutual sliding of the pads is furnished in an area in which the first pad and the second pad are mutually in contact;

wherein the first pad and the second pad have a roughly circular dish shape;

wherein a first sliding member protrudes from an attachment surface of either the first pad or the second pad, the first sliding member having a roughly arc shaped portion that protrudes from the attachment surface in the cross-section in the direction of the diameter of said first or second pad;

wherein a flat shaped second sliding member is disposed on the outer periphery of the other pad from the pad that has the first sliding member, the second sliding member located in a position that faces the first sliding member; and wherein the second sliding member is one that is formed such that the width of the second sliding member in the direction in which the first sliding member is in contact with and slides on the second sliding member, is at least the distance that the first sliding member slides based on the striking of the first pad.

5. An electronic percussion instrument, comprising:

a first pad having a striking surface comprising an elastic body;

first fixing means with which the first pad is fixed such that the pad is free to swing on a rod that moves up and down in accordance with a specified operation;

a second pad that faces the first pad;

second fixing means with which the second pad is fixed such that the pad is free to swing on the rod and in a position in which it is possible to transfer the swinging motion of the first pad to the second pad;

a first sensor with which a striking of the first pad is detected; and a second sensor that detects if the roughly arc shaped portion of the first sliding member has made contact with the second sliding member or if the second sliding member has been pressed, wherein a sliding member that promotes the mutual sliding of the pads is furnished in an area in which the first pad and the second pad are mutually in contact;

wherein the first pad and the second pad have a roughly circular dish shape;

wherein a first sliding member protrudes from an attachment surface of either the first pad or the second pad, the first sliding member having a roughly arc shaped portion that protrudes from the attachment surface in the cross-section in the direction of the diameter of said first or second pad;

wherein a flat shaped second sliding member is disposed on the outer periphery of the other pad from the pad that has the first sliding member, the second sliding member located in a position that faces the first sliding member; and wherein the second sensor comprises:

a first film member on which a first conductive pattern has been formed on one side;

a second film member on which a second conductive pattern has been formed on the surface that is opposite the surface on which the first conductive pattern has been formed on the first film member; and an insulating member, disposed between the second film member and the first film member, the insulating member comprising an insulating body in which a plurality of pass-through areas are disposed with which is possible for the first conductive pattern and the second conductive pattern to come into contact in those cases where either one of the first film member or the second film member have been pressed by the roughly arc shaped portion of the first sliding member.

6. The electronic percussion instrument of claim 5, wherein a pair of second sensors are disposed on the pad that is furnished with the second sliding member, on the rear surface side, which is the surface on the side that is facing the first sliding member, in positions on a line segment in the direction of the diameter roughly symmetrical with respect to the center.

7. An electronic percussion instrument, comprising:

a first pad having a striking surface comprising an elastic body;

first fixing means with which the first pad is fixed such that the pad is free to swing on a rod that moves up and down in accordance with a specified operation;

a second pad that faces the first pad;

second fixing means with which the second pad is fixed such that the pad is free to swing on the rod and in a position in which it is possible to transfer the swinging motion of the first pad to the second pad; and a first sensor with which a striking of the first pad is detected, wherein the first pad has a first insert-through-hole disposed in roughly the center of the first pad through which it is possible to insert the rod, and a concave section that has a groove shaped bottom portion;

wherein the first fixing means comprises a rotation stopping member that can be fit so that there is play with respect to the concave section, and a first checking member that checks and stops the first pad with respect to the rotation stopping member in those cases where the rotation stopping member has been fit to the concave section so that there is play, and a pad fixing member that fixes the first pad to the rod that has been inserted through the first insert-through-hole; and wherein the rotation stopping member has a peaked section having an apex that corresponds to the groove shape in the concave section, and a second insert-through-hole with which it is possible to insert through the rod which is disposed in a position that corresponds to the first insert-through-hole in those cases where the rotation stopping member has been fit to the concave section so that there is play, and together with this, has an outer periphery that cannot pass through the first insert-through-hole.

8. The electronic percussion instrument of claim 7, wherein a cylindrical member is fixed as a single unit with the rotation stopping member and protrudes from the peaked section side of the second insert-through-hole;

wherein the cylindrical member has a male threaded section on a portion of an outer periphery of the cylindrical member;

wherein the cylindrical member extends through the first insert-through-hole when the rotation stopping member has been fit to the concave section of the first pad;

wherein it is possible for the rod to be inserted through the cylindrical member; and wherein the first checking member is furnished with a female threaded section that can be screwed onto the male threaded section of the cylindrical member.

9. The electronic percussion instrument of claim 7, further comprising:

a plate shaped sensor attachment member on which the first sensor is mounted, the sensor attachment member attached to the first pad;

wherein the sensor attachment member is attached in one of the regions of the first pad that are delimited by the extension of a line of the groove on the bottom portion of the concave section of the first pad, leaving a space between the portion of the sensor attachment member on which the first sensor has been attached and the first pad.

10. An electronic percussion instrument, comprising:

a first pad having a striking surface comprising an elastic body;

first fixing means with which the first pad is fixed such that the pad is free to swing on a rod that moves up and down in accordance with a specified operation;

a second pad that faces the first pad;

second fixing means with which the second pad is fixed such that the pad is free to swing on the rod and in a position in which it is possible to transfer the swinging motion of the first pad to the second pad; and a first sensor with which a striking of the first pad is detected, wherein the first sliding member that promotes the mutual sliding of the pads is furnished in an area in which the first pad and the second pad are mutually in contact;

wherein the first pad has a first insert-through-hole disposed in roughly the center of the first pad through which it is possible to insert the rod, and a concave section that has a groove shaped bottom portion;

wherein the first fixing means comprises a rotation stopping member that can be fit so that there is play with respect to the concave section, and a first checking member that checks and stops the first pad with respect to the rotation stopping member in those cases where the rotation stopping member has been fit to the concave section so that there is play, and a pad fixing member that fixes the first pad to the rod that has been inserted through the first insert-through-hole; and wherein the rotation stopping member has a peaked section having an apex that corresponds to the groove shape in the concave section, and a second insert-through-hole with which it is possible to insert through the rod which is disposed in a position that corresponds to the first insert-through-hole in those cases where the rotation stopping member has been fit to the concave section so that there is play, and together with this, has an outer periphery that cannot pass through the first insert-through-hole.

11. The electronic percussion instrument of claim 10, further comprising:

a plate shaped sensor attachment member on which the first sensor is mounted, the sensor attachment member attached to the first pad;

wherein the sensor attachment member is attached in one of the regions of the first pad that are delimited by the extension of a line of the groove on the bottom portion of the concave section of the first pad, leaving a space between the portion of the sensor attachment member on which the first sensor has been attached and the first pad.

12. An electronic percussion instrument, comprising:

a first pad having a striking surface comprising an elastic body;

first fixing means with which the first pad is fixed such that the pad is free to swing on a rod that moves up and down in accordance with a specified operation;

a second pad that faces the first pad;

second fixing means with which the second pad is fixed such that the pad is free to swing on the rod and in a position in which it is possible to transfer the swinging motion of the first pad to the second pad;

a first sensor with which a striking of the first pad is detected; and a plate shaped sensor attachment member on which the first sensor is mounted, the sensor attachment member attached to the first pad;

wherein a sliding member that promotes the mutual sliding of the pads is furnished in an area in which the first pad and the second pad are mutually in contact;

wherein the sensor attachment member is attached to the first pad leaving a space between the portion of the sensor attachment member on which the first sensor is mounted and the rear surface of the first pad;

wherein a particular one of either the sensor attachment member or the first pad has a latching hole that is in a portion of an outer edge section of the particular one;

wherein the other one of either the sensor attachment member or the first pad has a protuberant section that is disposed in a portion of an outer edge section of the other one; and wherein the protuberant section is mated in the latching hole so that the sensor attachment member is attached to the first pad.

13. The electronic percussion instrument of claim 12, wherein a rib is disposed in portions of the outer edge section of the sensor attachment member other than the portion of the outer edge section of the sensor attachment member in which the sensor attachment member has the latching hole or protuberant section.

14. The electronic percussion instrument of claim 12, wherein the first sensor is attached roughly in a center section of the sensor attachment member.

15. An electronic percussion instrument, comprising:

a first pad having a striking surface comprising an elastic body;

first fixing means with which the first pad is fixed such that the pad is free to swing on a rod that moves up and down in accordance with a specified operation;

a second pad that faces the first pad;

second fixing means with which the second pad is fixed such that the pad is free to swing on the rod and in a position in which it is possible to transfer the swinging motion of the first pad to the second pad;

a first sensor with which a striking of the first pad is detected; and a plate shaped sensor attachment member on which the first sensor is mounted, the sensor attachment member attached to the first pad, wherein the sensor attachment member is attached to the first pad leaving a space between the portion of the sensor attachment member on which the first sensor is mounted and the rear surface of the first pad;

wherein a particular one of either the sensor attachment member or the first pad has a latching hole that is in a portion of an outer edge section of the particular one;

wherein the other one of either the sensor attachment member or the first pad has a protuberant section that is disposed in a portion of an outer edge section of the other one;

wherein the protuberant section is mated in the latching hole so that the sensor attachment member is attached to the first pad; and wherein a rib is disposed in portions of the outer edge section of the sensor attachment member other than the portion of the outer edge section of the sensor attachment member in which the sensor attachment member has the latching hole or protuberant section.

16. The electronic percussion instrument of claim 15, wherein the first sensor is attached roughly in a center section of the sensor attachment member.

17. An electronic percussion instrument, comprising:

a first pad having a striking surface comprising an elastic body;

first fixing means with which the first pad is fixed such that the pad is free to swing on a rod that moves up and down in accordance with a specified operation;

a second pad that faces the first pad;

second fixing means with which the second pad is fixed such that the pad is free to swing on the rod and in a position in which it is possible to transfer the swinging motion of the first pad to the second pad; and a first sensor with which a striking; of the first pad is detected, wherein the second pad has a third insert-through-hole in roughly a circular shape in roughly a center portion of the second pad;

wherein the second pad has a pair of groove sections that protrude toward the outside in the direction of the diameter of the circular shape and through which the rod that can be inserted;

wherein the second fixing means comprises a pedestal member on which the second pad is mounted, and a second checking member that presses and stops the second pad against the pedestal member in those cases where the second pad is arranged on the pedestal member; and wherein the pedestal member has a flat section with a portion having a roughly flat surface on which the second pad is installed, and a pair of convex portions that protrude from the flat section and can mate with the groove sections of the second pad, and a fourth insert-through-hole that has a roughly circular shape and is linked to the third insert-through-hole in those cases where the convex portions and the groove sections have been mated and through which the rod can be inserted.

18. The electronic percussion instrument of claim 17, wherein the second checking member has a flat plate section having an outer circumference that will not pass through the third insert-through-hole;

wherein the second checking member has a latching section that protrudes from the flat plate section and with which latching of the convex portions of the pedestal member can be done;

wherein the second checking member has a cylindrical section that protrudes from the flat plate section and has an outside diameter that is possible to insert through the third insert-through-hole and fourth insert-through-hole;

wherein the second checking member has a length such that an end portion protrudes from the fourth insert-through-hole in those cases where the cylindrical section has been inserted through the third insert-through-hole; and wherein the second checking member has a male threaded portion that is formed on the cylindrical section and a female threaded portion that can be screwed onto the male threaded portion.

19. The electronic percussion instrument of claim 18, further comprising:

a third sensor that has a sensor sheet member in which the electrical resistance value changes in conformance with an amount of pressing, and a spring member that has a roughly conical shape, and in those cases where an edge section of a wide mouth side of the spring member is brought into contact with the sensor sheet member and a pressing force that accompanies the displacement due to the lowering of the first pad is applied from a side opposite the wide mouth side, the amount of pressing on the sensor sheet member increases in accordance with an increase in the pressing force; and a case member in which the third sensor is housed;

wherein an outside bottom surface of the case is a flat plate shaped area that has an outer periphery that is not able to pass through the third insert-through-hole.

20. The electronic percussion instrument of claim 19, wherein the sensor sheet member is disposed long and narrowly in an area that corresponds roughly to the direction of the diameter of the edge section of the wide mouth side of the spring member;

wherein the sensor sheet member has a film member for pressing, which has a pressing section that transmits an amount of pressing by the spring member;

wherein the sensor sheet member has a second film member that is arranged on a surface of a side of the film member that is opposite that of the side for pressing;

wherein the sensor sheet member has a conductive section, which is arranged long and narrowly in a position that corresponds to the pressing section and has electrical conductivity; and wherein the sensor sheet member has an electrode section that is arranged facing the conductive section and is arranged long and narrowly in a position that corresponds to the conductive section.

21. The electronic percussion instrument of claim 19, further comprising:

a cylindrical shaped rod insert-through-tube that is linked in a single unit with the cylindrical section and is disposed passing through roughly the center of the sensor sheet member and the spring member viewed from the top and through which the rod can be inserted.

22. The electronic percussion instrument of claim 17, wherein the second fixing member has a pair of first holding sections that are disposed on the pedestal member;

wherein the second fixing member has an elastic body arm section that has a portion of the elastic body that is held that can be attached and removed; and wherein the second fixing member has a second holding section with which the body arm section can be attached and removed on an axis that is on the same axis as the rod.

23. The electronic percussion instrument of claim 22, wherein the second pad is roughly a circular dish shape; and wherein two wall sections are disposed standing on the rear surface side of the second pad, which is the surface that faces the first pad, and on the periphery of the third insert-through-hole, excluding at least the groove sections, and in two locations in which apices of the wall sections are shifted roughly 90 degrees from said groove sections on the arc of the third insert-through-hole, the wall sections inclined downward from the respective apices.

24. The electronic percussion instrument of claim 23, wherein a direction in which the respective apices of the two wall sections that have been disposed on the second pad are linked and a direction of the groove shape on the bottom portion of the concave section of the first pad, roughly coincide.

25. The electronic percussion instrument of claim 24, wherein the first pad has a first terminal insertion fitting hole on the rear surface side having an opening portion with which it is possible to insert and fit a terminal from an outer periphery; and wherein the second pad has a second terminal insertion fitting hole on the rear surface side that has an opening portion with which it is possible to insert and fit a terminal from an outer periphery in a location that faces the opening portion of the first terminal insertion fitting hole.

26. The electronic percussion instrument of claim 25, further comprising:

a roughly "L" shaped first terminal section that is inserted and fit into the opening portion of the first terminal insertion fitting hole;

a cable that has flexibility, through which it is possible to transmit an electrical signal, an end of the cable linked to the first terminal section; and a roughly "L" shaped second terminal section that is linked to another end of the cable and is inserted and fit into the second terminal insertion fitting hole.

27. The electronic percussion instrument of claim 24, wherein the first pad and the second pad are roughly circular dish shaped;

wherein the sliding member is disposed on a particular pad of either one of the first pad or the second pad;

wherein the sliding member has a first sliding member that has a roughly arc shaped portion that protrudes from an attachment surface of said particular pad in the cross-section in the direction of the diameter;

wherein the sliding member has a flat shaped second sliding member that has been disposed on the outer periphery of the other pad from the particular pad in a location that faces the first sliding member;

wherein the instrument further comprises a second sensor that detects when the arc shaped portion of the first sliding member that protrudes from the attachment surface in the cross-section in the direction of the diameter of the particular pad has come into contact with the second sliding member or has pressed on the second sliding member; and wherein a pair of second sensors are disposed on the other pad from the particular pad in a location roughly symmetrical with the center of the circular dish shape, in a direction in which the respective apices of the two wall sections that have been disposed on the second pad are linked or on a line segment in the direction of the groove shape on the bottom portion of the concave section of the first pad.

28. The electronic percussion instrument of claim 23, wherein the second pad has a third terminal insertion fitting hole on the obverse surface side that roughly coincides with the direction in which the respective apices of the two wall sections that have been disposed on the second pad are linked and in which it is possible to insert and fit a terminal from the outer periphery side.

29. An electronic percussion instrument, comprising:

a first pad having a striking surface comprising an elastic body;

first fixing means with which the first pad is fixed such that the pad is free to swing on a rod that moves up and down in accordance with a specified operation;

a second pad that faces the first pad;

second fixing means with which the second pad is fixed such that the pad is free to swing on the rod and in a position in which it is possible to transfer the swinging motion of the first pad to the second pad; and a first sensor with which a striking of the first pad is detected, wherein a sliding member that promotes the mutual sliding of the pads is furnished in an area in which the first pad and the second pad are mutually in contact;

wherein the second pad has a third insert-through-hole in roughly a circular shape in roughly a center portion of the second pad;

wherein the second pad has a pair of groove sections that protrude toward the outside in the direction of the diameter of the circular shape and through which the rod that can be inserted;

wherein the second fixing means comprises a pedestal member on which the second pad is mounted, and a second checking member that presses and stops the second pad against the pedestal member in those cases where the second pad is arranged on the pedestal member; and wherein the pedestal member has a flat section with a portion having a roughly flat surface on which the second pad is installed, and a pair of convex portions that protrude from the flat section and can mate with the groove sections of the second pad, and a fourth insert-through-hole that has a roughly circular shape and is linked to the third insert-through-hole in those cases where the convex portions and the groove sections have been mated and through which the rod can be inserted.

30. The electronic percussion instrument of claim 29, wherein the second checking member has a flat plate section having an outer circumference that will not pass through the third insert-through-hole;

wherein the second checking member has a latching section that protrudes from the flat plate section and with which latching of the convex portions of the pedestal member can be done;

wherein the second checking member has a cylindrical section that protrudes from the flat plate section and has an outside diameter that is possible to insert through the third insert-through-hole and fourth insert-through-hole;

wherein the second checking member has a length such that an end portion protrudes from the fourth insert-through-hole in those cases where the cylindrical section has been inserted through the third insert-through-hole; and wherein the second checking member has a male threaded portion that is formed on the cylindrical section and a female threaded portion that can be screwed onto the male threaded portion.

31. The electronic percussion instrument of claim 30, further comprising:

a third sensor that has a sensor sheet member in which the electrical resistance value changes in conformance with an amount of pressing, and a spring member that has a roughly conical shape, and in those cases where an edge section of a wide mouth side of the spring member is brought into contact with the sensor sheet member and a pressing force that accompanies the displacement due to the lowering of the first pad is applied from a side opposite the wide mouth side, the amount of pressing on the sensor sheet member increases in accordance with an increase in the pressing force; and a case member in which the third sensor is housed;

wherein an outside bottom surface of the case is a flat plate shaped area that has an outer periphery that is not able to pass through the third insert-through-hole.

32. The electronic percussion instrument of claim 31, wherein the sensor sheet member is disposed long and narrowly in an area that corresponds roughly to the direction of the diameter of the edge section of the wide mouth side of the spring member;

wherein the sensor sheet member has a film member for pressing, which has a pressing section that transmits an amount of pressing by the spring member;

wherein the sensor sheet member has a second film member that is arranged on a surface of a side of the film member that is opposite that of the side for pressing;

wherein the sensor sheet member has a conductive section, which is arranged long and narrowly in a position that corresponds to the pressing section and has electrical conductivity; and wherein the sensor sheet member has an electrode section that is arranged facing the conductive section and is arranged long and narrowly in a position that corresponds to the conductive section.

33. The electronic percussion instrument of claim 31, further comprising:

a cylindrical shaped rod insert-through-tube that is linked in a single unit with the cylindrical section and is disposed passing through roughly the center of the sensor sheet member and the spring member viewed from the top and through which the rod can be inserted.

34. The electronic percussion instrument of claim 29, wherein the second fixing member has a pair of first holding sections that are disposed on the pedestal member;

wherein the second fixing member has an elastic body arm section that has a portion of the elastic body that is held that can be attached and removed; and wherein the second fixing member has a second holding section with which the body arm section can be attached and removed on an axis that is on the same axis as the rod.

35. The electronic percussion instrument of claim 34, wherein the second pad is roughly a circular dish shape; and wherein two wall sections are disposed standing on the rear surface side of the second pad, which is the surface that faces the first pad, and on the periphery of the third insert-through-hole, excluding at least the groove sections, and in two locations in which apices of the wall sections are shifted roughly 90 degrees from said groove sections on the arc of the third insert-through-hole, the wall sections inclined downward from the respective apices.

36. The electronic percussion instrument of claim 35, wherein a direction in which the respective apices of the two wall sections that have been disposed on the second pad are linked and a direction of the groove shape on the bottom portion of the concave section of the first pad, roughly coincide.

37. The electronic percussion instrument of claim 36, wherein the first pad has a first terminal insertion fitting hole on the rear surface side having an opening portion with which it is possible to insert and fit a terminal from an outer periphery; and wherein the second pad has a second terminal insertion fitting hole on the rear surface side that has an opening portion with which it is possible to insert and fit a terminal from an outer periphery in a location that faces the opening portion of the first terminal insertion fitting hole.

38. The electronic percussion instrument of claim 37, further comprising:

a roughly "L" shaped first terminal section that is inserted and fit into the opening portion of the first terminal insertion fitting hole;

a cable that has flexibility, through which it is possible to transmit an electrical signal, an end of the cable linked to the first terminal section; and a roughly "L" shaped second terminal section that is linked to another end of the cable and is inserted and fit into the second terminal insertion fitting hole.

39. The electronic percussion instrument of claim 36, wherein the first pad and the second pad are roughly circular dish shaped;

wherein the sliding member is disposed on a particular pad of either one of the first pad or the second pad;

wherein the sliding member has a first sliding member that has a roughly arc shaped portion that protrudes from an attachment surface of said particular pad in the cross-section in the direction of the diameter;

wherein the sliding member has a flat shaped second sliding member that has been disposed on the outer periphery of the other pad from the particular pad in a location that faces the first sliding member;

wherein the instrument further comprises a second sensor that detects when the arc shaped portion of the first sliding member that protrudes from the attachment surface in the cross-section in the direction of the diameter of the particular pad has come into contact with the second sliding member or has pressed on the second sliding member; and wherein a pair of second sensors are disposed on the other pad from the particular pad in a location roughly symmetrical with the center of the circular dish shape, in a direction in which the respective apices of the two wall sections that have been disposed on the second pad are linked or on a line segment in the direction of the groove shape on the bottom portion of the concave section of the first pad.

40. The electronic percussion instrument of claim 35, wherein the second pad has a third terminal insertion fitting hole on the obverse surface side that roughly coincides with the direction in which the respective apices of the two wall sections that have been disposed on the second pad are linked and in which it is possible to insert and fit a terminal from the outer periphery side.

41. An electronic percussion instrument comprising:

a first pad having a striking surface comprising an elastic body, the pad fixed to a rod, the pad having a first insert-through-hole that is located in roughly a center portion of the pad and receiving the rod, and a concave section that has a groove shaped bottom portion on a rear surface that is the reverse side of the striking surface and that crosses through roughly a center portion of the first insert-through-hole;

a rotation stopping member, which is fit to the concave section so that there is play, that has a peaked section having an apex that is shaped in conformance with the groove shaped bottom portion of said concave section, and a second insert-through-hole that is disposed in a location that corresponds to the first insert-through-hole in those cases where the rotation stopping member has been fit to said concave section so that there is play, the second insert-through-hole receiving the rod, and together with this, has an outer periphery that cannot pass through the first insert-through-hole;

a cylindrical member that is fixed as a single unit with the rotation stopping member and protrudes from the peaked section side of the second insert-through-hole, and has a male threaded section on a portion of an outer periphery, the male threaded section receiving the rod, and together with this, it is possible to insert through the first insert-through-section, and has a length that protrudes from the first insert-through-section in those cases where the rotation stopping member has been fit to the concave section so that there is play;

a checking member that is furnished with a female threaded section that can be screwed onto the male threaded section, and in those cases where the rotation stopping member has been fit to the concave section so that there is play, said female threaded section is screwed onto the male threaded section and presses on the pad, and the pad is pressed against the rotation stopping member and stopped;

a pad fixing member that is disposed in a single unit with a front end of the cylindrical member and fixes the pad to the rod that has been inserted through the first insert-through-hole;

a second pad fixable to the rod and operable to swine, the second pad fixable at a location on the rod such that the second pad can be contacted by the first pad when the first pad swings; and a first sensor for detecting a strike on the first pad, wherein the first pad further comprises a first sliding element that facilitates sliding of the first pad on the second pad when the first pad contacts the second pad; and wherein the first sliding element comprises a sliding tube.

42. An electronic percussion instrument, comprising:

a first pad comprising a striking surface formed of an elastic material, the first pad fixable to a rod and operable to swing;

a second pad fixable to the rod and operable to swing, the second pad fixable at a location on the rod such that the second pad can be contacted by the first pad when the first pad swings; and a first sensor for detecting a strike on the first pad, wherein the first pad further comprises a first sliding element that facilitates sliding of the first pad on the second pad when the first pad contacts the second pad; and wherein the first sliding element comprises a sliding tube.

43. The electronic percussion instrument of claim 42, wherein the second pad comprises a second sliding element that facilitates sliding of the first pad on the second pad when the first pad contacts the second pad.

44. The electronic percussion instrument of claim 43, wherein the second sliding element comprises a sliding film.

45. The electronic percussion instrument of claim 42, wherein the second pad comprises a second sliding element that facilitates sliding of the first pad on the second pad when the first pad contacts the second pad; and wherein the first sliding element contacts the second sliding element when the first pad contacts the second pad.

46. The electronic percussion instrument of claim 45, wherein the first sliding element is located on a bottom edge surface of the first pad; and wherein the second sliding element is located on a top edge surface of the second pad.

47. The electronic percussion instrument of claim 46, wherein when the first pad and the second pad are fixed to the rod, the first pad is located above the second pad and the first sliding element is centered above the second sliding element.

48. The electronic percussion instrument of claim 45, wherein the first sliding element is arc shaped.

49. The electronic percussion instrument of claim 45, wherein the first sliding element protrudes from a bottom surface of the first pad.

50. The electronic percussion instrument of claim 42, wherein the first sliding element contacts the second pad when the first pad contacts the second pad; and wherein a second sensor is located on the second pad in a location where the first sliding element contacts the second pad.

51. The electronic percussion instrument of claim 42, further comprising:

a first fixing element for fixing the first pad to the rod; and a second fixing element for fixing the second pad to the rod.

52. The electronic percussion instrument of claim 42, wherein the rod is movable between a first position and a second position; and wherein when the first pad and the second pad are fixed to the rod and the rod moves from the first position to the second position, the first pad contacts the second pad.

53. The electronic percussion instrument of claim 42, further comprising:

a rotation stopping member;

wherein the first pad has a concave section on a bottom surface of the first pad; and wherein the rotation stopping member is fit into the concave section when the first pad is fixed to the rod so that the first pad can swing in an up and down motion, but cannot rotate around the rod.

54. The electronic percussion instrument of claim 53, further comprising:

a second fixing element;

wherein the second pad has a groove section; and wherein the second fixing element has a convex section that is fit into the groove section of the second pad when the second pad is fixed on the rod so that the second pad can swing in an up and down motion, but cannot rotate around the rod.

55. The electronic percussion instrument of claim 54, wherein the rod is movable between a first position and a second position; and wherein when the first pad and the second pad are fixed to the rod and the rod moves from the first position to the second position, the first pad contacts the second pad.

56. The electronic percussion instrument of claim 55, wherein the striking surface of the first pad is located on a front side of the first pad;

wherein a second sensor is located on a right side of the second pad;

wherein a third sensor is located on a left side of the second pad; and wherein the second sensor and the third sensor detect when the first pad contacts the second pad on the left side and right side of the second pad at the same time.

57. The electronic percussion instrument of claim 42, further comprising:

a second fixing element;

wherein the second pad has a groove section; and wherein the second fixing element has a convex section that is fit into the groove section of the second pad when the second pad is fixed on the rod so that the second pad can swing in an up and down motion, but cannot rotate around the rod.

58. The electronic percussion instrument of claim 42, wherein the rod is a hollow shaft.

59. The electronic percussion instrument of claim 42, wherein the first pad and the second pad are a circular dish shape.

60. The electronic percussion instrument of claim 59, wherein the first pad further comprises a sensor attachment frame separated by a gap from the striking surface; and wherein the first sensor is attached to the sensor attachment frame.

61. The electronic percussion instrument of claim 60, wherein the sensor attachment frame is located in a front semicircle of the first pad;

wherein the first pad has a hollow section located in a back semicircle of the first pad; and wherein a weight element is enclosed in the hollow section to balance the weight of the back semicircle with the weight of the front semicircle.

62. The electronic percussion instrument of claim 42, wherein the first sliding element comprises at least one of nylon and TEFLON.

63. The electronic percussion instrument of claim 42, further comprising:

a fixing element for fixing the second pad to the rod;

a displacement sensor for detecting a displacement of the first pad; and a case for housing the displacement sensor;

wherein the second pad comprises a bottom frame with a first protuberant section and a second protuberant section;

wherein the first and second protuberant sections have a dome like shape with an apex;

wherein the rod passes through an insert hole in the second pad when the second pad is fixed to the rod;

wherein when the second pad is fixed to the rod, the first and second protuberant sections contact a bottom surface of the case.

64. The electronic percussion instrument of claim 42, further comprising:

a displacement sensor comprising a spring and fixable to the rod, the displacement sensor for detecting a displacement of the first pad;

wherein the rod passes through a first insert hole in the first pad when the first pad is fixed to the rod;

wherein the rod passes through a second insert hole in the second pad when the second pad is fixed to the rod; and wherein when the displacement sensor is fixed to the rod, the displacement sensor is located between the first pad and the second pad, and the rod passes through the spring in the displacement sensor.

65. The electronic percussion instrument of claim 64, wherein the displacement sensor further comprises:

a base plate with a conductive section;

a spacer film supported on the base plate;

a resistance section supported on the spacer film; and a pressing film supported on the resistance section;

wherein the spring is supported on the pressing film;

wherein the spring comprises a wider portion at a bottom where the spring is supported on the pressing film and a narrower portion at a top;

wherein when the spring is compressed, the narrower portion contacts the pressing film and the resistance section contacts the conductive section.

66. An electronic percussion instrument, comprising:

a first pad comprising a striking surface formed of an elastic material, the first pad fixable to a rod and operable to swing;

a second pad fixable to the rod and operable to swing, the second pad fixable at a location on the rod such that the second pad can be contacted by the first pad when the first pad swings; and a first sensor for detecting a strike on the first pad, wherein the first pad further comprises a first sliding element that facilitates sliding of the first pad on the second pad when the first pad contacts the second pad;

wherein the second pad comprises a second sliding element that facilitates sliding of the first pad on the second pad when the first pad contacts the second pad;

wherein the first sliding element contacts the second sliding element when the first pad contacts the second pad;

wherein the first sliding element comprises a sliding tube; and wherein the second sliding element comprises a sliding film.

67. The electronic percussion instrument of claim 66, wherein the sliding film has a width that is at least the maximum distance that the sliding tube can slide on the second pad when the first pad and the second pad are fixed to the rod.

68. An electronic percussion instrument, comprising:

a first pad comprising a striking surface formed of an elastic material, the first pad fixable to a rod and operable to swing;

a second pad fixable to the rod and operable to swing, the second pad fixable at a location on the rod such that the second pad can be contacted by the first pad when the first pad swings; and a first sensor for detecting a strike on the first pad, wherein the first pad further comprises a first sliding element that facilitates sliding of the first pad on the second pad when the first pad contacts the second pad;

wherein the second pad comprises a second sliding element that facilitates sliding of the first pad on the second pad when the first pad contacts the second pad;

wherein the first sliding element contacts the second sliding element when the first pad contacts the second pad; and wherein the first sliding element is tube shaped.

* * * * *